US005347826A

United States Patent [19]

Hayashida et al.

[11] Patent Number: 5,347,826

[45] Date of Patent: Sep. 20, 1994

[54] AIR CONDITIONER

[75] Inventors: Noriaki Hayashida; Hidekazu Tani; Takashi Nakamura, all of Wakayama, Japan

[73] Assignee: Mitsubishi Denki Kabushiki Kaisha, Tokyo, Japan

[21] Appl. No.: 67,973

[22] Filed: May 27, 1993

[30] Foreign Application Priority Data

May 28, 1992 [JP] Japan ..... 4-137038

[51] Int. Cl.[5] ..... F25B 41/00

[52] U.S. Cl. ..... 62/197; 62/117

[58] Field of Search ..... 62/117, 160, 197

[56] References Cited

U.S. PATENT DOCUMENTS

| | | | |
|---|---|---|---|
| 4,230,470 | 10/1980 | Matsuda et al. | 62/197 |
| 4,959,971 | 10/1990 | Minari | 62/197 |
| 5,065,588 | 11/1991 | Nakayama et al. | 62/160 |
| 5,163,503 | 11/1992 | Inoue | 165/13 |
| 5,237,833 | 8/1993 | Hayashida et al. . | |

FOREIGN PATENT DOCUMENTS

| | | | |
|---|---|---|---|
| 0339267 | 11/1989 | European Pat. Off. . | |
| 0392673 | 10/1990 | European Pat. Off. . | |
| 3720889 | 1/1988 | Fed. Rep. of Germany . | |
| 1-134172 | 5/1989 | Japan . | |
| 2-118372 | 5/1990 | Japan . | |
| 4151462 | 5/1992 | Japan | 62/197 |
| WO80/01102 | 5/1980 | PCT Int'l Appl. . | |

*Primary Examiner*—William E. Wayner

*Attorney, Agent, or Firm*—Oblon, Spivak, McClelland, Maier & Neustadt

[57] ABSTRACT

A multi-chamber heat-pump type air conditioner in which a plurality of room units (2, 3, 4) are connected to one heat source unit (1), cooling and heating can be effected selectively for each room unit (2, 3, 4), and cooling can be effected by one room unit and heating can be simultaneously effected by another, wherein the high-level pressure or low-level pressure is controlled from rising high as compared to the time of normal operation, and the reliability of the compressor (17) is improved. In which, a third pressure-detector (48) is provided for detecting a rise in pressure between a compressor (17) and a four-way changeover valve (18), and a control circuit (49) is provided for controlling such that, in the event that the pressure within the pipe is below a predetermined pressure, a sixth valve (45) and a seventh valve (46) are closed, while in the event that the pressure within the pipe exceeds the predetermined pressure, the sixth valve (45) and seventh valve (46) are opened.

5 Claims, 16 Drawing Sheets

AIR CONDITIONER

BACKGROUND OF THE INVENTION

1. Field of Invention

The present invention relates to control of a multi-chamber heat-pump type air conditioner in which a plurality of room units are connected to one heat source unit, and cooling and heating can be effected selectively for each room unit, and cooling can be effected by one room unit and heating can be simultaneously effected by another.

2. Description of Prior Art

A description will be given hereafter of the prior art of the present invention.

FIG. 13 is an overall schematic diagram of an air conditioner in accordance with a prior art example relating to the present invention, centering on a refrigerant system. In addition, FIGS. 14 to 16 show states of operation during cooling and heating operation in accordance with the prior art example shown in FIG. 13, in which FIG. 14 is a diagram of the state of operation during only cooling or heating, while FIGS. 15 and 16 show diagrams of states of the simultaneous operation of cooling and heating, FIG. 15 being a diagram of a state of operation in which heating is mainly performed (a case where the capacity for heating operation is greater than that for cooling operation), and FIG. 16 being a diagram of a state of operation in which cooling is mainly performed (a case where the capacity for cooling operation is greater than that for heating operation).

It should be noted that in this example a description will be given of a case where three room units are connected to one heat source unit, but it also similarly applies to cases where two or more room units are connected thereto.

In FIG. 13, reference numeral 1 denotes a heat source unit, and numerals 1, 2 and 4 denote room units which are connected in parallel with each other, as will be described later, and the same arrangement is used for the respective units. Numeral 5 denotes a relay unit which incorporates a first branching section 6, a second flow-rate controller 7, a second branching section 8, a gas-liquid separator 9, heat exchanger 10, 11, 12, 13, 14, a third flow-rate controller 15, and a fourth flow-rate controller 16, as will be described later.

In addition, numeral 17 denotes a compressor; 18, a four-way changeover valve for changing over the direction of circulation of a refrigerant of the heat source unit; 19, a heat source unit-side heat exchanger; and 20, an accumulator which is connected to the compressor 17 via the four-way changeover valve 18. The heat source unit 1 is comprised of these units.

In addition, numeral 21 denotes a room unit-side heat exchanger provided for each of the three room units 2, 3, 4; 22, a large-diameter first connecting pipe for connecting together the four-way changeover valve 18 of the heat source unit 1 and the relay unit 5 via a fourth check valve 23 which will be described later; numerals 24, 25, 26 denote room unit-side first connecting pipes which respectively connect the room unit-side heat exchanger 21 of the room units 2, 3, 4 to the relay unit 5 and correspond to the first connecting pipe 22; and 27 denotes a second connecting pipe having a diameter smaller than that of the aforementioned first connecting pipe and used for connecting together heat source unit-side heat exchanger 19 of the heat source unit 1 and the relay unit 5 via a third check valve 28 which will be described later.

In addition, numerals 29, 30, 31 respectively denote room unit-side second connecting pipes for connecting together the room unit-side heat exchanger 21 of the room units 2, 3, 4 and the relay unit 5 via first flow rate controllers 36, and corresponding to the second connecting pipes 27.

Numeral 33 denotes a first valve for allowing the room unit-side first connecting pipes 24, 25, 26 to communicate with the first connecting pipe 22; 34, a second valve for allowing the room unit-side first connecting pipes 24, 25, 26 to communicate with the second connecting pipe 27; and 35, a third valve for bypassing inlet and outlet ports of the first valve 33.

Numeral 36 denotes a first flow-rate controller which is connected in the vicinity of the room unit-side heat exchanger 21 and is controlled by a superheated amount at the outlet of the room unit-side heat exchanger 21 during cooling and by a subcooled amount thereat during heating, the first flow-rate controllers 36 being connected to the room unit-side second connecting pipes 29, 30, 31.

Numeral 6 denotes the first branching section which includes the first valves 33 and the second valves 34 for selectively connecting the room unit-side first connecting pipes 24, 25, 26 to the first connecting pipe 22 or the second connecting pipe 27, as well as the third valves 35 for bypassing the inlet and outlet ports of the first valves 33.

Numeral 8 denotes the second branching section which includes the room unit-side second connecting pipes 29, 30, 31 and the second connecting pipe 27.

Numeral 9 denotes the gas-liquid separator disposed in a midway position of the second connecting pipe 27, and its vapor phase portion is connected to the second valves 34 at the first branching section, while its liquid phase portion is connected to the second branching section 8.

Numeral 7 denotes the second flow-rate controller (here, an electric expansion valve) which can be opened or closed freely and is connected between the gas-liquid separator 9 and the second branching section 8.

Numeral 37 denotes a bypass pipe for connecting together second branching section 8 and the first connecting pipe 22; 15, the third flow-rate controller (here, an electric expansion valve) disposed in a midway position of the bypass pipe 37; and 10, the second heat-exchange portion which is disposed downstream of the third flow-rate controller 15 disposed in the midway position of the bypass pipe 37 and effects heat exchange at a converging portion of the respective room unit-side second connecting pipes 29, 30, 31 in the second branching section 8.

Numerals 11, 12, 13 respectively denote the third heat-exchange portions which are disposed downstream of the third flow-rate controller 15 disposed in the midway position of the bypass pipe 37, and effect heat exchange with the respective room unit-side second connecting pipes 29, 30, 31 in the second branching section 8.

Numeral 14 denotes the first heat exchanger which is disposed downstream of the third flow-rate controller 15 of the bypass pipe 37 and downstream of the second heat-exchange portion 10, and effects heat exchange with the pipe connecting the gas-liquid separator 9 and the second flow-rate controller 7; and numeral 16 denotes the fourth flow-rate controller (here, an electric expansion valve) which can be opened or closed freely and is connected between the second branching section 8 and the first connecting pipe 22.

Meanwhile, numeral 28 denotes the third check valve which is disposed between the heat source unit-side heat exchanger 19 and the second connecting pipe 27, and allows circulation of the refrigerant only from the heat source unit-side heat exchanger 19 to the second connecting pipe 27.

Numeral 23 denotes the fourth check valve which is disposed between the four-way changeover valve 18 of the heat source unit 1 and the first connecting pipe 22, and allows circulation of the refrigerant only from the first connecting pipe 22 to the four-way changeover valve 18.

Numeral 38 denotes a fifth check valve which is disposed between the four-way changeover valve 18 of the heat source unit 1 and the second connecting pipe 27, and allows circulation of the refrigerant only from the four-way changeover valve 18 to the second connecting pipe 27.

Numeral 39 denotes a sixth check valve which is disposed between the heat source unit-side heat exchanger 19 and the first connecting pipe 22, and allows circulation of the refrigerant only from the first connecting pipe 22 to the heat source unit-side heat exchanger 19.

The aforementioned third, fourth, fifth, and sixth check valves 28, 23, 38, 39 constitute a channel-changeover device 40.

Numeral 41 denotes a first pressure-detecting means disposed between the first branching section 6 and the second flow-rate controller 7; and 42 denotes a second pressure-detecting means disposed between the second flow-rate controller 7 and the fourth flow-rate controller 16.

Next, a description will be given of the operation. First, a description will be given of the case of cooling operation only, with reference to FIG. 14. As indicated by the solid-line arrows in the drawing, a high-temperature high-pressure refrigerant gas discharged from the compressor 17 passes through the four-way changeover valve 18, undergoes heat exchange with heat source water in the heat source unit-side heat exchanger 19, and is thereby condensed. The condensed refrigerant then passes through the third check valve 28, the second connecting pipe 27, the gas-liquid separator 9, and the second flow-rate controller in that order, further passes through the second branching section 8 and the room unit-side second connecting pipes 29, 30, 31, and flows into the respective room units 2, 3, 4.

The refrigerant which has entered the room units 2, 3, 4 is made to undergo decompression to a low pressure by the first flow-rate controllers 36 controlled by the superheated amounts at the outlets of the room unit-side heat exchanger 21. The refrigerant then undergoes heat exchange with the air within the rooms by means of the room unit-side heat exchanger 21, whereupon the refrigerant evaporates and gasifies, thereby cooling the interior of the rooms.

The refrigerant in this gaseous state forms a circulation cycle in which it passes through the room unit-side first connecting pipes 24, 25, 26, the first valves 33, the third valves 35, the first connecting pipe 22, the fourth check valve 23, the four-way changeover valve 18 of the heat source unit 1, and the accumulator 20, and is then sucked by the compressor 17, so as to effect the cooling operation.

At that time, the first valves 33 and the third valves 35 are open, while the second valves 34 are closed. In addition, since the first connecting pipe 22 is held under a low pressure and the second connecting pipe 27 under a high pressure at that time, the refrigerant naturally flows to the third check valve 28 and the fourth check valve 23.

In addition, during this cycle, part of the refrigerant which has passed through the second flow-rate controller 7 enters the bypass pipe 37 and is decompressed to a low pressure by the third flow-rate controller 15. The decompressed refrigerant is then subjected to heat exchange with the room unit-side second connecting pipes 29, 30, 31 in the second branching section 8 by the third heat-exchange portions 11, 12, 13, and with the converging portion of the room unit-side second connecting pipes 29, 30, 31 in the second branching section 8 by the second heat-exchange portion 10, and further with the refrigerant flowing into the second flow-rate controller 7 by the first heat-exchange portion 14, and is thereby evaporated. The evaporated refrigerant enters the first connecting pipe 22 and the fourth check valve 23, passes through the four-way changeover valve 18 of the heat source unit 1 and the accumulator 20, and is sucked in by the compressor 17.

Meanwhile, the refrigerant at the second branching section 8, which has been cooled after being subjected to heat exchange at the first, second and third heat-exchange portions 14, 10, 11, 12, 13 and provided sufficiently with subcooling, flows into the room units 2, 3, 4 to be cooled.

Referring now to FIG. 14, a description will be given of the case of heating operation only. Namely, as indicated by the dotted-line arrows in the drawing, the high-temperature high-pressure refrigerant gas discharged from the compressor 17 passes through the four-way changeover valve 18, passes through the fifth check valve 38, the second connecting pipe 27, and the gas-liquid separator 9, passes consecutively through the second valves 34 and the room unit-side first connecting pipes 24, 25, 26, and flows into the respective room units 2, 3, 4, where the refrigerant undergoes heat exchange with the air within the rooms, and condenses and liquefies, thereby heating the interior of the rooms.

The refrigerant in this liquid state is controlled by the subcooled amounts at the outlets of the room unit-side heat exchanger 21, passes through the first flow-rate controllers 36 in the substantially open state, flows into the second branching section 8 from the room unit-side second connecting pipes 29, 30, 31 and converges, and further passes through the fourth flow-rate controller 16.

Here, the refrigerant is decompressed to a low-pressure gas-liquid two-phase state by either the first flow-rate controllers 36 or the third and fourth flow-rate controllers 15, 16.

The refrigerant decompressed to a low pressure forms a circulation cycle in which the refrigerant passes through the first connecting pipe 22, flows into the sixth check valve 39 of the heat source unit 1 and the heat source unit-side heat exchanger 19, where the refrigerant exchanges heat with the heat source water, evaporates and assumes a gaseous state, and is sucked in by the compressor 17 through the four-way changeover valve 18 of the heat source unit 1 and the accumulator 20, so as to effect the heating operation.

At that time, the second valves 34 are open, while the first valves 33 and the third valves 35 are closed. In addition, since the first connecting pipe 22 is held under a low pressure and the second connecting pipe 27 under a high pressure at that time, the refrigerant naturally flows to the fifth check valve 38 and the sixth check valve 39.

It should be noted that at that time the second flow-rate controller 7 is normally set in a state of being open by a predetermined minimum amount.

Referring now to FIG. 15, a description will be given of the case where heating is mainly carried out in the simultaneous operation of cooling and heating. As indicated by the dotted-line arrows in the drawing, the high-temperature high-pressure refrigerant gas discharged from the compressor 17 passes through the four-way changeover valve 18, passes through the fifth check valve 38 and the second connecting pipe 27, is supplied to the relay unit 5, passes through the gas-liquid separator 9, passes consecutively through the second valves 34 and the room unit-side first connecting pipes 24, 25, and flows into the respective room units 2, 3, 4 to be heated, where the refrigerant undergoes heat exchange through the room unit-side heat exchanger 21, and condenses and liquefies, thereby heating the interior of the rooms.

This condensed and liquefied refrigerant is controlled by the subcooled amounts at the outlets of the room unit-side heat exchanger 21, passes through the first flow-rate controllers 36, where it is slightly decompressed and flows into the second branching section 8.

Part of this refrigerant passes through the room unit-side second connecting pipe 31, enters the room unit 4 to be cooled, enters the first flow-rate controller 36 controlled by the superheated amount at the outlet of the room unit-side heat exchanger 21. After the refrigerant is decompressed, the refrigerant enters the room unit-side heat exchanger 21 where it undergoes heat exchange, evaporates and assumes the gaseous state to cool the interior of the room. The refrigerant then passes through the first connecting pipe 26 at the room unit-side, and flows into the first connecting pipe 22 via the first valve 33 and the third valve 35. Meanwhile, a remaining portion of the refrigerant passes through the fourth flow-rate controller 16 which is controlled such that a pressure difference between the pressure detected by the first pressure-detecting means 41 and the pressure detected by the second pressure-detecting means 42 is set in a predetermined range. The refrigerant then converges with the refrigerant which has passed through the room unit 4 to be cooled, passes through the large-diameter first connecting pipe 22, flows into the sixth check valve 39 of the heat source unit 1 and the heat source unit-side heat exchanger 19, and undergoes heat exchange with the heat source water, and thereby evaporates and assumes the gaseous state.

This refrigerant forms a circulation cycle in which the room unit passes through the four-way changeover valve 18 of the heat source unit 1 and the accumulator 20 and is sucked in by the compressor 17, so as to effect the operation in which heating is mainly performed.

At that time, the pressure difference between the low pressure of the room unit-side heat exchanger 36 of the room unit 4 for effecting cooling and the pressure of the heat source unit-side heat exchanger 19 becomes small since the line is changed over to the large-diameter first connecting pipe 22.

In addition, at that time, the second valves 34 connected to the room units 2, 3 are open, while the first valves 33 and the third valves 35 connected thereto are closed. The first valve 33 and the third valve 35 connected to the room unit 4 are open, while the second valve 34 connected thereto is closed.

In addition, since the first connecting pipe 22 is held under a low pressure and the second connecting pipe 27 under a high pressure at that time, the refrigerant naturally flows to the fifth check valve 38 and the sixth check valve 39.

During this cycle, part of the liquid refrigerant enters the bypass pipe 37 from the converging portion of the room unit-side second connecting pipes 29, 30, 31 in the second branching section 8, and is decompressed to a low pressure by the third flow-rate controller 15. The decompressed refrigerant is then subjected to heat exchange with the room unit-side second connecting pipes 29, 30, 31 in the second branching section 8 by the third heat exchanger 11, 12, 13, and with the converging portion of the room unit-side second connecting pipes 29, 30, 31 in the second branching section 8 by the second heat-exchange portion 10. The evaporated refrigerant passes through the first connecting pipe 22 and the sixth check valve 39, enters the heat source unit-side heat exchanger 19 where it undergoes heat exchange with the heat source water and is evaporated. Subsequently, the evaporated refrigerant passes through the four-way changeover valve 18 of the heat source unit 1 and the accumulator 20, and is sucked in by the compressor 17.

Meanwhile, the refrigerant at the second branching section 8, which has been cooled after being subjected to heat exchange at the second and third heat-exchange portions 10, 11, 12, 13 and provided sufficiently with subcooling, flows into the room unit 4 to be cooled.

It should be noted that at that time the second flow-rate controller 7 is normally set in a state of being open by a predetermined minimum amount.

Referring now to FIG. 16, a description will be given of the case where cooling is mainly carried out in the simultaneous operation of cooling and heating. As indicated by the dotted-line arrows in the drawing, the high-temperature high-pressure refrigerant gas discharged from the compressor 17 passes through the four-way changeover valve 18, flows into the heat source unit-side heat exchanger 19 where the refrigerant undergoes heat exchange with the heat source water, and is thereby set in a gas-liquid two-phase high-temperature high-pressure state.

Subsequently, the refrigerant in this two-phase high-temperature high-pressure state passes through the third check valve 28 and the second connecting pipe 27, and is supplied to the gas-liquid separator 9 of the relay unit 4.

Here, the refrigerant is separated into the gaseous refrigerant and the liquid refrigerant, and the separated gaseous refrigerant passes consecutively through the second valve 34 and the room unit-side first connecting pipe 26, and flows into the room unit 5 to be heated, where the refrigerant undergoes heat exchange with room air through the room unit-side heat exchanger 21, and condenses and liquefies, thereby heating the interior of the room.

This condensed and liquefied refrigerant is controlled by the subcooled amount at the outlet of the room unit-side heat exchanger 21, passes through the first flow-rate controller 36, where it is slightly decompressed and flows into the second branching section 8.

Meanwhile, a remaining portion of the liquid refrigerant passes through the second flow-rate controller 7 which is controlled the pressure detected by the first pressure-detecting means 41 and the pressure detected by the second pressure-detecting means 42. The refrigerant then converges with the refrigerant which has passed through the room unit 4 to be heated.

The refrigerant consecutively passes through the second branching section 8 and the room unit-side second connecting pipes 29, 30, and flows into the respective room units 2, 3. The refrigerant which has entered the room units 2, 3 is decompressed to a low pressure by the first flow-rate controllers 36 which is controlled by superheated amounts at the outlets of the room unit-side heat exchanger 21. The refrigerant then flows into the room unit-side heat exchanger 21, undergoes heat exchange with room air, and evaporates and gasifies, thereby cooling the interior of the rooms.

The refrigerant in this gaseous state forms a circulation cycle in which the room unit passes through the room unit-side first connecting pipes 24, 25, the first valves 33, the third valves 35, the first connecting pipe 22, the fourth check valve 23, the four-way changeover valve 18 of the heat source unit 1, and the accumulator 20, and is sucked in by the compressor 17, so as to effect the operation in which cooling is mainly performed.

In addition, at that time, the first valves 33 and the third valves 35 connected to the room units 2, 3 are open, while the second valves 34 connected thereto are closed. The second valve 34 connected to the room unit 4 is open, while the first valve 33 and the third valve 35 connected thereto are closed.

Since the first connecting pipe 22 is held under a low pressure and the second connecting pipe 27 under a high pressure at that time, the refrigerant naturally flows to the third check valve 28 and the fourth check valve 23.

During this cycle, part of the liquid refrigerant enters the bypass pipe 37 from the converging portion of the room unit-side second connecting pipes 29, 30, 31 in the second branching section 8, and is decompressed to a low pressure by the third flow-rate controller 15. The decompressed refrigerant is then subjected to heat exchange with the room unit-side second connecting pipes 29, 30, 31 in the second branching section 8 by the third heat exchanger 11, 12, 13, and with the converging portion of the room unit-side second connecting pipes 29, 30, 31 in the second branching section 8 by the second heat-exchange portion 10, and further with the refrigerant flowing into the second flow-rate controller 7 by the first heat-exchange portion 14. The evaporated refrigerant passes through the first connecting pipe 22 and the fourth check valve 23, and further passes through the four-way changeover valve 18 of the heat source unit 1 and the accumulator 20, and is sucked in by the compressor 17.

Meanwhile, the refrigerant at the second branching section 8, which has been cooled after being subjected to heat exchange at the first, second and third heat-exchange portions 14, 10, 11, 12, 13 and provided sufficiently with subcooling, flows into the room units 2, 3 to be cooled.

Since the conventional multi-chamber heat-pump type air conditioner is arranged as described above, there has been a problem in that, in the case of totally cooling operation and mainly cooling operation when the temperature of the heat source water is high, the air conditioner stops due to an abnormality in high-level pressure and an abnormality in discharge temperature as a result of an increase in the condensation pressure. In addition, there has been another problem in that, in the case of totally heating operation and mainly heating operation of a small-capacity room unit when the room air temperature is high, the air conditioner similarly stops due to an abnormality in high-level pressure and abnormality in discharge temperature as a result of an increase in the condensation pressure. Furthermore, there has been still another problem in that, in the case of totally heating operation and mainly heating operation when the heat source temperature is high, the low-level pressure deviates from an allowable range of operation of the compressor due to a rise in evaporation pressure, thereby adversely affecting the reliability of the compressor. It should be noted that Japanese Patent Application Laid-Open (Kokai) Hei-1-118372/(1989) is known as a similar technique.

The present invention has been devised to overcome the above-described problems, and its object is to provide a multi-chamber heat-pump type air conditioner in which a plurality of room units are connected to one heat source unit, cooling and heating can be effected selectively for each room unit, and cooling can be effected by one room unit and heating can be simultaneously effected by another, wherein the high-level pressure or low-level pressure is controlled from rising high as compared to the time of normal operation, and the reliability of the compressor is not impaired.

To attain the above object, there is provided an air conditioner wherein a heat source unit-side heat exchanger which includes a compressor, a four-way changeover valve, a plurality of heat exchanger connected in parallel with each other and each having a fourth and a fifth valve at inlet and outlet ports thereof, and an accumulator, and a plurality of room units each including a room unit-side heat exchanger, a first flow-rate controller, and a room blower, are connected to each other via a first connecting pipe and a second connecting pipe, a second flow-rate controller being interposed between, on the one hand, a first branching section having a first valve and a second valve for allowing one ends of the room unit-side heat exchanger of the plurality of room units to communicate selectively with the first connecting pipe or a gas-side output port of a gas-liquid separator disposed in a room unit-side pipe end of the second connecting pipe and, on the other, a second branching section in which other ends of the plurality of room unit-side heat exchanger are connected to the second connecting pipe via the first flow-rate controllers, the second branching section and the first connecting pipe being connected to each other via a fourth flow-rate controller, there being provided a bypass pipe having one end connected to the second branching section and another end connected to the first connecting pipe via a third flow-rate controller, there being provided a heat-exchange portion for effecting heat exchange with a pipe connecting together the second connecting pipe and the first flow-rate controller, a relay constituted by the first branching section, the second branching section, the second flow-rate controller, the third flow-rate controller, the fourth flow-rate controller, the heat-exchange portion, and the bypass pipe is interposed between the room unit and the plurality of room units, characterized in that a gas side of one of the heat exchanger of the heat source unit-side heat exchanger and a discharge side of the compressor are connected to each other via a sixth valve, that a liquid side of that heat exchanger and an inlet port of the accumulator are connected to each other via a capillary tube and a seventh valve, and that there are provided pressure-detecting means for detecting the pressure within a discharge-side pipe of the compressor and a control circuit for controlling such that when the pipe pressure is below a predetermined pressure, the sixth valve and the seventh valve are closed, and when the pipe pressure exceeds the predetermined pressure, the sixth valve and the seventh valve are opened.

Alternatively, an arrangement may be provided such that a gas side of one of the heat exchanger of the heat source unit-side heat exchanger and a discharge side of the compressor are connected to each other via a sixth valve, that a liquid side of that heat exchanger and an inlet port of the accumulator are connected to each other via a capillary tube and a seventh valve, and that there are provided temperature-detecting means for detecting the temperature of the discharge side of the compressor and a control circuit for controlling such that when the discharge temperature is below a predetermined temperature, the sixth valve and the seventh valve are closed, and when the discharge temperature exceeds the predetermined temperature, the sixth valve and the seventh valve are opened.

Alternatively, an arrangement may be provided such that a gas side of one of the heat exchanger of the heat source unit-side heat exchanger and a discharge side of the compressor are connected to each other via a sixth valve, that a liquid side of that heat exchanger and an inlet port of the accumulator are connected to each other via a capillary tube and a seventh valve, and that there are provided pressure-detecting means for detecting the pressure within an inlet port-side pipe of the accumulator and a control circuit for controlling such that when the pipe pressure is below a predetermined pressure, the sixth valve and the seventh valve are closed, and when the pipe pressure exceeds the predetermined pressure, the sixth valve and the seventh valve are opened.

Alternatively, an arrangement may be provided such that a gas side of one of the heat exchanger of the heat source unit-side heat exchanger and a discharge side of the compressor are connected to each other via a sixth valve, that a liquid side of that heat exchanger and an inlet port of the accumulator are connected to each other via a capillary tube and a seventh valve, that a liquid side of that heat source unit-side heat exchanger and an inlet port of the accumulator are connected to each other by means of an evaporation-temperature detecting circuit, and that there are provided temperature-detecting means for detecting the an evaporation temperature in the evaporation-temperature detecting means and a control circuit for controlling such that when the evaporation temperature is below a predetermined temperature, the sixth valve and the seventh valve are closed, and when the evaporation temperature exceeds the predetermined temperature, the sixth valve and the seventh valve are opened.

OPERATION

The air conditioner according to the present invention is arranged as follows: The gas side of one of the heat source unit-side heat exchanger and the discharge side of the compressor are connected to each other via a sixth valve, the liquid side of that heat exchanger and the inlet port of the accumulator are connected to each other via a capillary tube and a seventh valve. Pressure-detecting means for detecting the pressure within the discharge-side pipe of the compressor and a control circuit for controlling these valves are provided. When a high-level pressure detected by a third pressure-detecting means is below a first set pressure, the sixth and seventh valves are closed, while when the high-level pressure rises above the first set pressure, the sixth and seventh valves are opened. Accordingly, it is possible to control an excessive rise in the high-level pressure.

Alternatively, temperature-detecting means for detecting the temperature of the discharge side of the compressor and a control circuit for controlling these valves are provided. When the discharge temperature detected by the temperature-detecting means is below a first predetermined temperature, the sixth and the seventh valves are closed, while when the discharge temperature rises above the first set temperature, the sixth and seventh valves are opened. Accordingly, it is possible to control an excess rise in the discharge temperature.

Alternatively, pressure-detecting means for detecting the pressure within an inlet port-side pipe of the accumulator and a control circuit for controlling these valves are provided. When the low-level pressure detected by a fourth pressure-detecting means is below a second set pressure, the sixth and seventh valves are closed, while when it rises above the second set pressure, the sixth and seventh valves are opened. Accordingly, it is possible to control an excessive rise in the low-level pressure.

Alternatively, the liquid side of the heat source unit-side heat exchanger and an inlet port of the accumulator are connected to each other by means of an evaporation-temperature detecting circuit, and a control circuit for controlling these valves is provided. When the evaporation temperature detected by the evaporation-temperature detecting means is below a second predetermined temperature, the sixth and seventh valves are closed, while when the evaporation temperature rises above the second set temperature, the sixth and seventh valves are opened. Accordingly, it is possible to control an excessive rise in the evaporation temperature.

DETAILED DESCRIPTION OF THE PREFERRED EMBODIMENTS

First Embodiment

Hereafter, a description will be given of an embodiment of the present invention.

Figure 1:
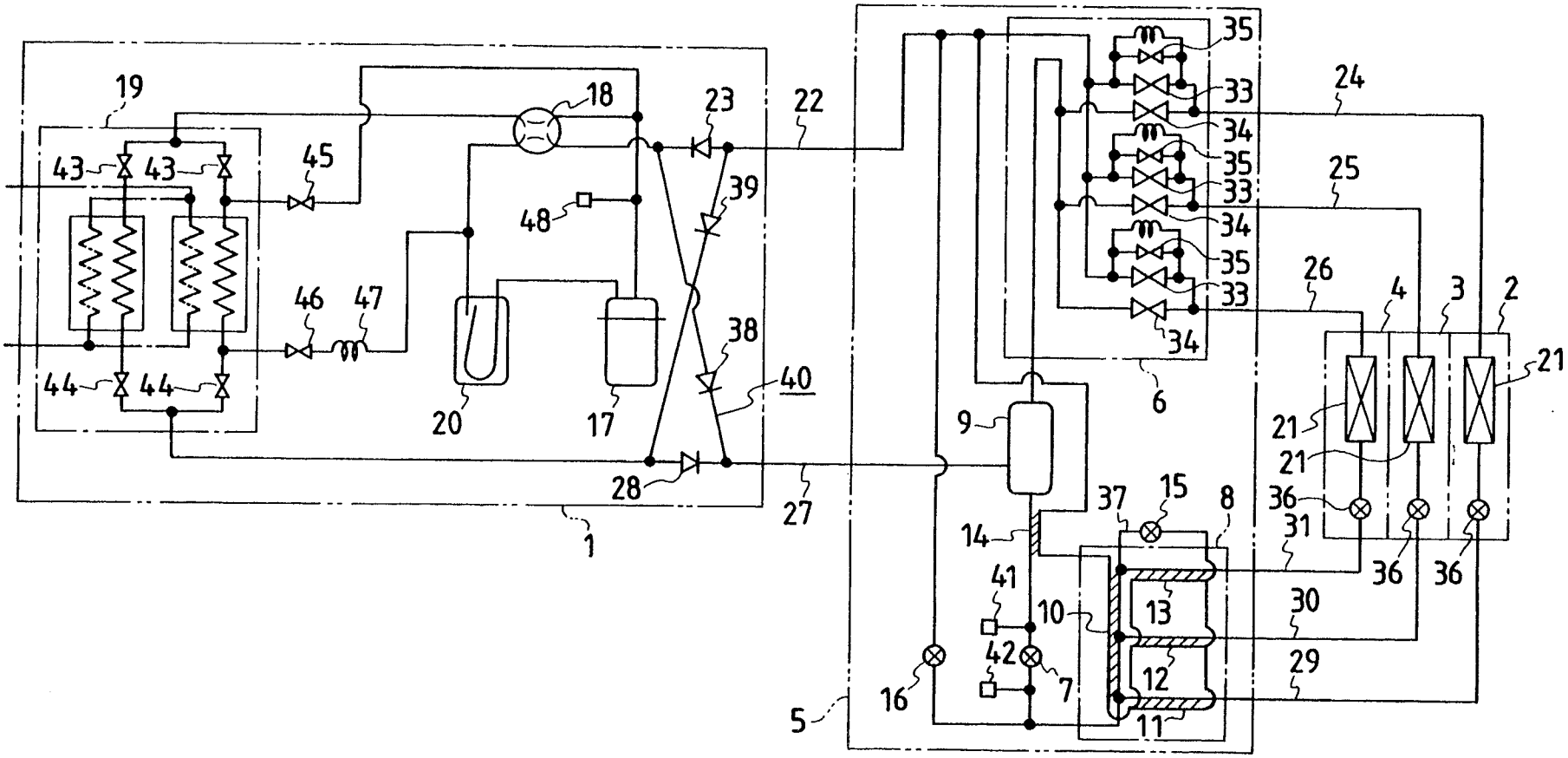
FIG. 1 is an overall schematic diagram of an air conditioner in accordance with a first embodiment of the invention, centering on a refrigerant system.
Figure 2:
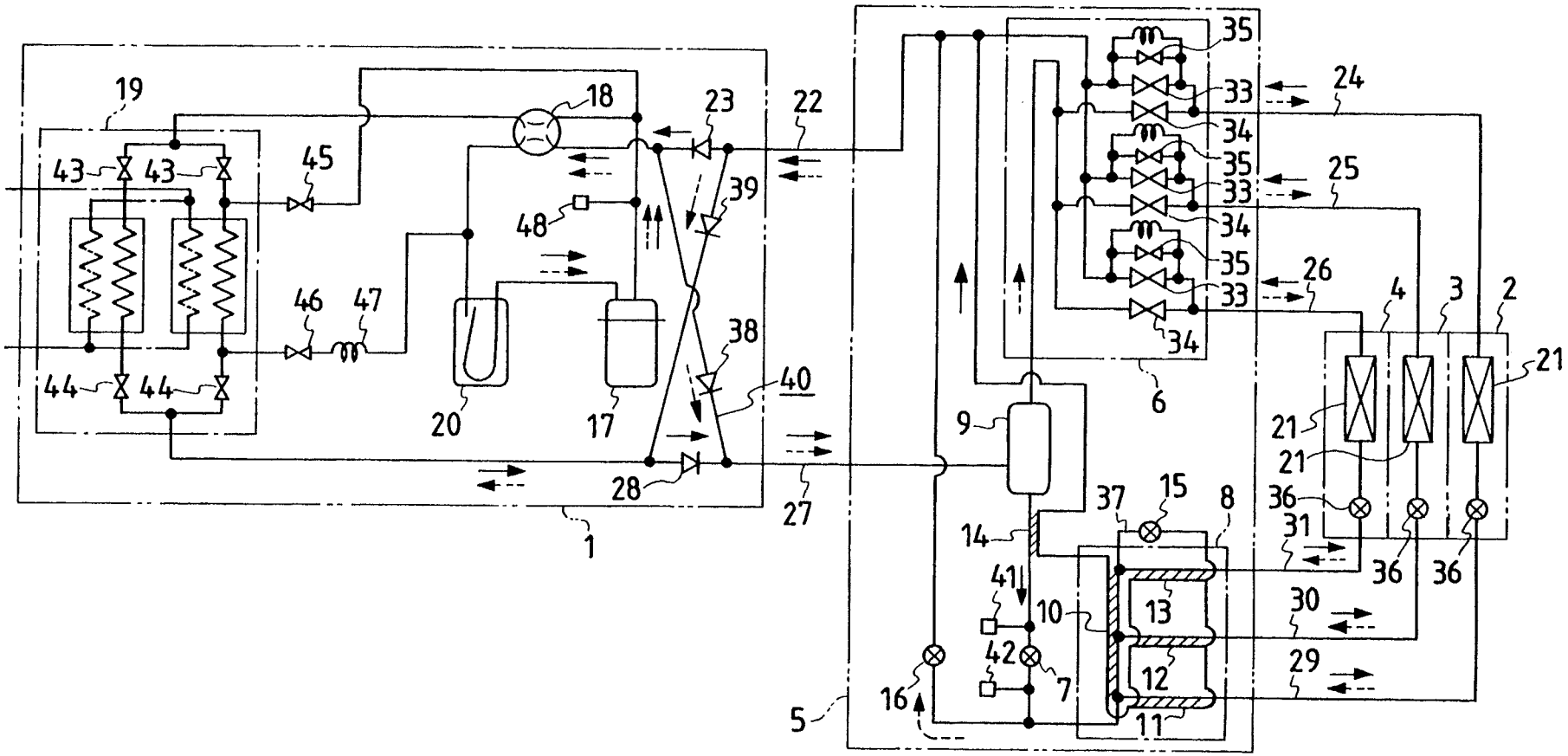
FIG. 2 is a circuit diagram of the refrigerant illustrating the state of operation of only cooling or heating by the air conditioner in accordance with the first embodiment of the present invention.
Figure 3:
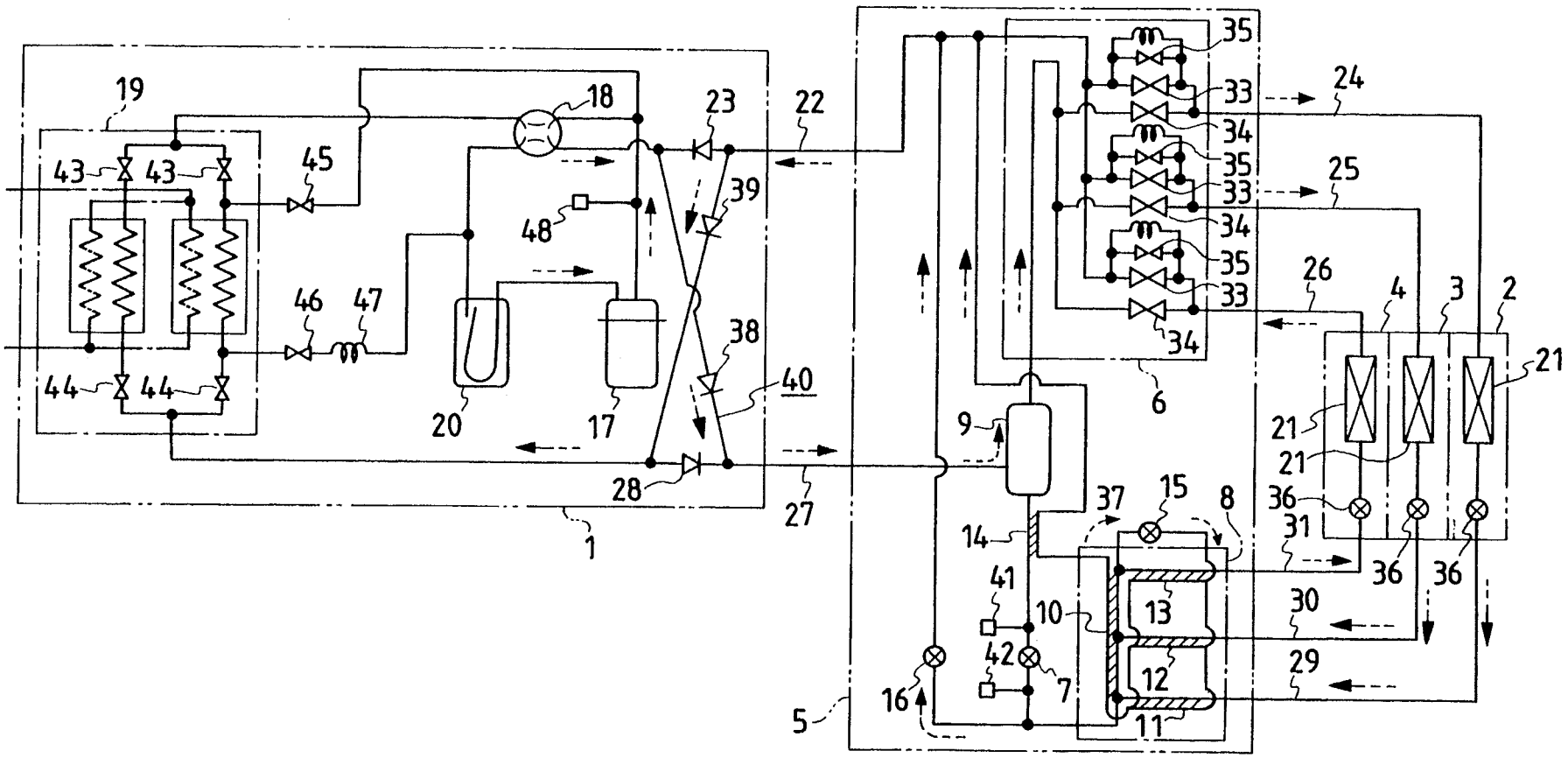
FIG. 3 is a circuit diagram of the refrigerant illustrating the state of operation of mainly heating by the air conditioner in accordance with the first embodiment of the present invention.
Figure 4:
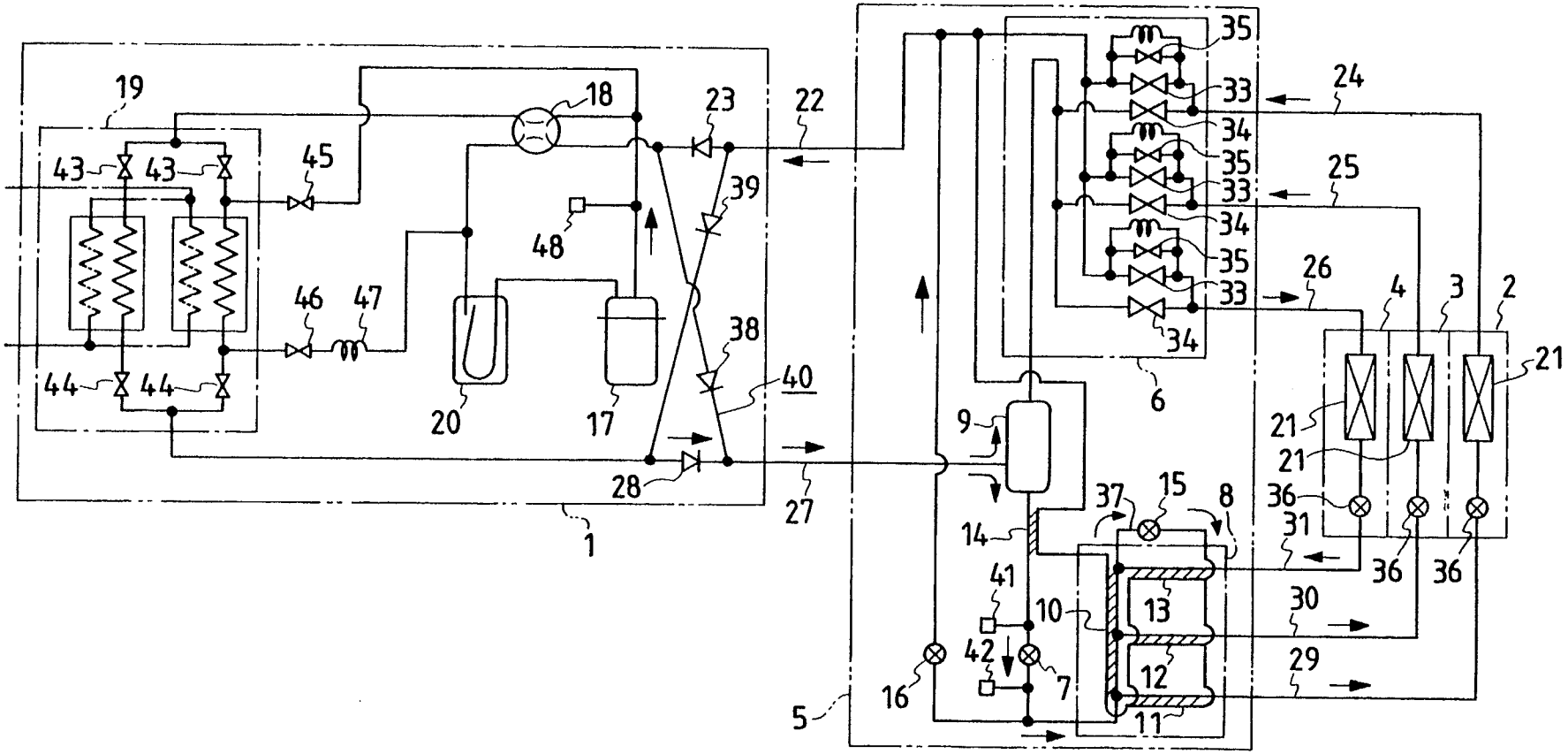
FIG. 4 is a circuit diagram of the refrigerant illustrating the state of operation of mainly cooling by the air conditioner in accordance with the first embodiment of the present invention.

FIG. 1 is an overall schematic diagram of an air conditioner in accordance with an embodiment of the present invention, centering on a refrigerant system. FIGS. 2 to 4 are diagrams illustrating states of operation during cooling and heating operation in the first embodiment, in which FIG. 2 is a diagram of a state of operation of only cooling or heating, FIG. 3 is a diagram of a state of operation in which heating is mainly performed (a case where the capacity for heating operation is greater than that for cooling operation) in the simultaneous operation of cooling and heating, and FIG. 4 is a diagram of a state of operation in which cooling is mainly performed (a case where the capacity for cooling operation is greater than that for heating operation) in the simultaneous operation of cooling and heating.

It should be noted that in this first embodiment a description will be given of a case where three room units are connected to one heat source unit, but it also similarly applies to cases where two or more room units are connected thereto.

In FIG. 1, reference numeral 1 denotes a heat source unit, and numerals 2, 3 and 4 denote room units which are connected in parallel with each other, as will be described later, and the same arrangement is used for the respective units. Numeral 5 denotes a relay unit which incorporates a first branching section 6, a second flow-rate controller 7, a second branching section 8, a gas-liquid separator 9, heat exchange-portions 10, 11, 12, 13, 14, a third flow-rate controller 15, and a fourth flow-rate controller 16, as will be described later.

In addition, numeral 17 denotes a compressor; 18, a four-way changeover valve for changing over the direction of circulation of a refrigerant of the heat source unit; 19, a heat source unit-side heat exchanger consisting a plurality of heat exchanger which are connected in parallel with each other and each having a fourth valve 43 and a fifth valve 44 at inlet and outlet ports thereof; and 20, an accumulator which is connected to the compressor 17 via the four-way changeover valve 18. Numeral 45 denotes a sixth valve connected to a bypass pipe for connecting the gas side of one of the aforementioned heat source unit-side heat exchanger 19 and the discharge side of the compressor 17. Numeral 46 denotes a seventh valve connected to a bypass pipe for connecting the liquid side of that heat exchanger and an inlet of the accumulator 20 via a capillary tube 47. Numeral 48 denotes a third pressure-detecting means disposed between the compressor 17 and the four-way changeover valve 18.

In addition, numeral 21 denotes a room unit-side heat exchanger provided for each of the three room units 2, 3, 4; 22, a large-diameter first connecting pipe for connecting together the four-way changeover valve 18 of the heat source unit 1 and the relay unit 5 via a fourth check valve 23 which will be described later; numerals 24, 25, 26 denote room unit-side first connecting pipes which respectively connect the room unit-side heat exchanger 21 of the room units 2, 3, 4 to the relay unit 5 and correspond to the first connecting pipe 22; and 27 denotes a second connecting pipe having a diameter smaller than that of the aforementioned first connecting pipe and used for connecting together heat source unit-side heat exchanger 19 of the heat source unit 1 and the relay unit 5 via a third check valve 28 which will be described later.

In addition, numerals 29, 30, 31 respectively denote room unit-side second connecting pipes for connecting together the room unit-side heat exchanger 21 of the room units 2, 3, 4 and the relay unit 5, and corresponding to the second connecting pipes 27.

Numeral 33 denotes a first valve for allowing the room unit-side first connecting pipes 24, 25, 26 to communicate with the first connecting pipe 22; 34, a second valve for allowing the room unit-side first connecting pipes 24, 25, 26 to communicate with the second connecting pipe 27; and 35, a third valve for bypassing inlet and outlet ports of the first valve 21.

Numeral 36 denotes a first flow-rate controller which is connected in the vicinity of the room unit-side heat exchanger 21 and is controlled by a superheated amount at the outlet of the room unit-side heat exchanger 21 during cooling and by a subcooled amount thereat during heating, the first flow-rate controllers 36 being connected to the room unit-side second connecting pipes 29, 30, 31.

Numeral 6 denotes the first branching section which includes the first valves 33 and the second valves 34 for selectively connecting the room unit-side first connecting pipes 24, 25, 26 to the first connecting pipe 22 or the second connecting pipe 27, as well as the third valves 35 for bypassing the inlet and outlet ports of the first valves 33.

Numeral 8 denotes the second branching section which includes the room unit-side second connecting pipes 29, 30, 31 and the second connecting pipe 27.

Numeral 9 denotes the gas-liquid separator disposed in a midway position of the second connecting pipe 27, and its vapor phase portion is connected to the second valves 34 at the first branching section, while its liquid phase portion is connected to the second branching section 8.

Numeral 7 denotes the second flow-rate controller (here, an electric expansion valve) which can be opened or closed freely and is connected between the gas-liquid separator 9 and the second branching section 8.

Numeral 37 denotes a bypass pipe for connecting together second branching section 8 and the first connecting pipe 22; 15, the third flow-rate controller (here, an electric expansion valve) disposed in a midway position of the bypass pipe 37; and 10, the second heat-exchange portion which is disposed downstream of the third flow-rate controller 15 disposed in the midway position of the bypass pipe 37 and effects heat exchange at a converging portion of the respective room unit-side second connecting pipes 29, 30, 31 in the second branching section 8.

Numerals 11, 12, 13 respectively denote the third heat-exchange portions which are disposed downstream of the third flow-rate controller 15 disposed in the midway position of the bypass pipe 37, and effect heat exchange with the respective room unit-side second connecting pipes 29, 30, 31 in the second branching section 8.

Numeral 14 denotes the first heat exchanger which is disposed downstream of the third flow-rate controller 15 of the bypass pipe 37 and downstream of the second heat-exchange portion 10, and effects heat exchange with the pipe connecting the gas-liquid separator 9 and the second flow-rate controller 7; and numeral 16 denotes the fourth flow-rate controller (here, an electric expansion valve) which can be opened or closed freely and is connected between the second branching section 8 and the first connecting pipe 22.

Meanwhile, numeral 32 denotes the third check valve which is disposed between the heat source unit-side heat exchanger 19 and the second connecting pipe 27, and allows circulation of the refrigerant only from the heat source unit-side heat exchanger 19 to the second connecting pipe 27.

Numeral 23 denotes the fourth check valve which is disposed between the four-way changeover valve 18 of the heat source unit 1 and the first connecting pipe 22, and allows circulation of the refrigerant only from the first connecting pipe 22 to the four-way changeover valve 18.

Numeral 38 denotes a fifth check valve which is disposed between the four-way changeover valve 18 of the heat source unit 1 and the second connecting pipe 27, and allows circulation of the refrigerant only from the four-way changeover valve 18 to the second connecting pipe 27.

Numeral 39 denotes a sixth check valve which is disposed between the heat source unit-side heat exchanger 19 and the first connecting pipe 22, and allows circulation of the refrigerant only from the first connecting pipe 22 to the heat source unit-side heat exchanger 19.

The aforementioned third, fourth, fifth, and sixth check valves 28, 23, 38, 39 constitute a channel-changeover device 40.

Numeral 41 denotes a first pressure-detecting means disposed between the first branching section 6 and the second flow-rate controller 7; and 42 denotes a second pressure-detecting means disposed between the second flow-rate controller 7 and the fourth flow-rate controller 16.

Numeral 45 denotes the sixth valve connected to a pipe for connecting the compressor 17 and the heat source unit-side heat exchanger 19, and numeral 46 denotes the seventh valve provided in the pipe for connecting the accumulator 20 and the heat source unit-side heat exchanger 19, together with a capillary tube 47.

Next, a description will be given of the operation. First, a description will be given of the case of cooling operation only, with reference to FIG. 2. As indicated by the solid-line arrows in the drawing, a high-temperature high-pressure refrigerant gas discharged from the compressor 17 passes through the four-way changeover valve 18, undergoes heat exchange with heat source water in the heat source unit-side heat exchanger 19, and is thereby condensed. The condensed refrigerant then passes through the third check valve 28, the second connecting pipe 27, the gas-liquid separator 9, and the second flow-rate controller in that order, further passes through the second branching section 8 and the room unit-side second connecting pipes 29, 30, 31, and flows into the respective room units 2, 3, 4.

The refrigerant which has entered the room units 2, 3, 4 is made to undergo decompression to a low pressure by the first flow-rate controllers 36 controlled by the superheated amounts at the outlets of the room unit-side heat exchanger 21. The refrigerant then undergoes heat exchange with the air within the rooms by means of the room unit-side heat exchanger 21, whereupon the refrigerant evaporates and gasifies, thereby cooling the interior of the rooms.

The refrigerant in this gaseous state forms a circulation cycle in which it passes through the room unit-side first connecting pipes 24, 25, 26, the first valves 33, the third valves 35, the first connecting pipe 22, the fourth check valve 23, the four-way changeover valve 18 of the heat source unit 1, and the accumulator 20, and is then sucked by the compressor 17, so as to effect the cooling operation.

At that time, the first valves 33 and the third valves 35 are open, while the second valves 34 are closed. In addition, since the first connecting pipe 22 is held under a low pressure and the second connecting pipe 27 under a high pressure at that time, the refrigerant naturally flows to the third check valve 28 and the fourth check valve 23.

In addition, during this cycle, part of the refrigerant which has passed through the second flow-rate controller 7 enters the bypass pipe 37 and is decompressed to a low pressure by the third flow-rate controller 15. The decompressed refrigerant is then subjected to heat exchange with the room unit-side second connecting pipes 29, 30, 31 in the second branching section 8 by the third heat-exchange portions 11, 12, 13, and with the converging portion of the room unit-side second connecting pipes 29, 30, 31 in the second branching section 8 by the second heat-exchange portion 10, and further with the refrigerant flowing into the second flow-rate controller 7 by the first heat-exchange portion 14, and is thereby evaporated. The evaporated refrigerant enters the first connecting pipe 22 and the fourth check valve 23, passes through the four-way changeover valve 18 of the heat source unit 1 and the accumulator 20, and is sucked in by the compressor 17.

Meanwhile, the refrigerant at the second branching section 8, which has been cooled after being subjected to heat exchange at the first, second and third heat-exchange portions 14, 10, 11, 12, 13 and provided sufficiently with subcooling, flows into the room units 2, 3, 4 to be cooled.

Referring now to FIG. 2, a description will be given of the case of heating operation only. Namely, as indicated by the dotted-line arrows in the drawing, the high-temperature high-pressure refrigerant gas discharged from the compressor 17 passes through the four-way changeover valve 18, passes through the fifth check valve 38, the second connecting pipe 27, and the gas-liquid separator 9, passes consecutively through the second valves 34 and the room unit-side first connecting pipes 24, 25, 26, and flows into the respective room units 2, 3, 4, where the refrigerant undergoes heat exchange with the air within the rooms, and condenses and liquefies, thereby heating the interior of the rooms.

The refrigerant in this liquid state is controlled by the subcooled amounts at the outlets of the room unit-side heat exchanger 21, passes through the first flow-rate controllers 36 in the substantially open state, flows into the second branching section 8 from the room unit-side second connecting pipes 29, 30, 31 and converges, and further passes through the fourth flow-rate controller 16.

Here, the refrigerant is decompressed to a low-pressure gas-liquid two-phase state by either the first flow-rate controllers 36 or the third and fourth flow-rate controllers 15, 16.

The refrigerant decompressed to a low pressure forms a circulation cycle in which the refrigerant passes through the first connecting pipe 22, flows into the sixth check valve 39 of the heat source unit 1 and the heat source unit-side heat exchanger 19, where the refrigerant exchanges heat with the heat source water, evaporates and assumes a gaseous state, and is sucked in by the compressor 17 through the four-way changeover valve 18 of the heat source unit 1 and the accumulator 20, so as to effect the heating operation.

At that time, the second valves 34 are open, while the first valves 33 and the third valves 35 are closed. In addition, since the first connecting pipe 22 is held under a low pressure and the second connecting pipe 27 under a high pressure at that time, the refrigerant naturally flows to the fifth check valve 38 and the sixth check valve 39.

It should be noted that at that time the second flow-rate controller 7 is normally set in a state of being open by a predetermined minimum amount.

Referring now to FIG. 3, a description will be given of the case where heating is mainly carried out in the simultaneous operation of cooling and heating. As indicated by the dotted-line arrows in the drawing, the high-temperature high-pressure refrigerant gas discharged from the compressor 17 passes through the four-way changeover valve 18, passes through the fifth check valve 38 and the second connecting pipe 27, is supplied to the relay unit 5, passes through the gas-liquid separator 9, passes consecutively through the second valves 34 and the room unit-side first connecting pipes 24, 25, and flows into the respective room units 2, 3, to be heated, where the refrigerant undergoes heat exchange through the room unit-side heat exchanger 21, and condenses and liquefies, thereby heating the interior of the rooms.

This condensed and liquefied refrigerant is controlled by the subcooled amounts at the outlets of the room unit-side heat exchanger 21, passes through the first flow-rate controllers 36, where it is slightly decompressed and flows into the second branching section 8.

Part of this refrigerant passes through the room unit-side second connecting pipe 31, enters the room unit 4 to be cooled, enters the first flow-rate controller 36 controlled by the superheated amount at the outlet of the room unit-side heat exchanger 21. After the refrigerant is decompressed, the refrigerant enters the room unit-side heat exchanger 21 where it undergoes heat exchange, evaporates and assumes the gaseous state to cool the interior of the room. The refrigerant then passes through the room unit-side first connecting pipe 26, and flows into the first connecting pipe 22 via the first valve 33 and the third valve 35.

Meanwhile, a remaining portion of the refrigerant passes through the fourth flow-rate controller 16 which is controlled such that a pressure difference between the pressure detected by the first pressure-detecting means 41 and the pressure detected by the second pressure-detecting means 42 is set in a predetermined range. The refrigerant then converges with the refrigerant which has passed through the room unit 4 to be cooled, passes through the large-diameter first connecting pipe 22, flows into the sixth check valve 39 of the heat source unit 1 and the heat source unit-side heat exchanger 19, and undergoes heat exchange with the heat source water, and thereby evaporates and assumes the gaseous state.

This refrigerant forms a circulation cycle in which the room unit passes through the four-way changeover valve 18 of the heat source unit 1 and the accumulator 20 and is sucked in by the compressor 17, so as to effect the operation in which heating is mainly performed.

At that time, the pressure difference between the low pressure of the room unit-side heat exchanger 21 of the room unit 4 for effecting cooling and the pressure of the heat source unit-side heat exchanger 19 becomes small since the line is changed over to the large-diameter first connecting pipe 22.

In addition, at that time, the second valves 34 connected to the room units 2, 3 are open, while the first valves 33 and the third valves 35 connected thereto are closed. The first valve 33 and the third valve 35 connected to the room unit 4 are open, while the second valve 34 connected thereto is closed.

In addition, since the first connecting pipe 22 is held under a low pressure and the second connecting pipe 27 under a high pressure at that time, the refrigerant naturally flows to the fifth check valve 38 and the sixth check valve 39.

During this cycle, part of the liquid refrigerant enters the bypass pipe 37 from the converging portion of the room unit-side second connecting pipes 29, 30, 31 in the second branching section 8, and is decompressed to a low pressure by the third flow-rate controller 15. The decompressed refrigerant is then subjected to heat exchange with the room unit-side second connecting pipes 29, 30, 31 in the second branching section 8 by the third heat exchanger 11, 12, 13, and with the converging portion of the room unit-side second connecting pipes 29, 30, 31 in the second branching section 8 by the second heat-exchange portion 10. The evaporated refrigerant passes through the first connecting pipe 22 and the sixth check valve 39, enters the heat source unit-side heat exchanger 19 where it undergoes heat exchange with heat source water and is evaporated. Subsequently, the evaporated refrigerant passes through the four-way changeover valve 18 of the heat source unit 1 and the accumulator 20, and is sucked in by the compressor 17.

Meanwhile, the refrigerant at the second branching section 8, which has been cooled after being subjected to heat exchange at the second and third heat-exchange portions 10, 11, 12, 13 and provided sufficiently with subcooling, flows into the room unit 4 to be cooled.

It should be noted that at that time the second flow-rate controller 7 is normally set in a state of being open by a predetermined minimum amount.

Referring now to FIG. 4, a description will be given of the case where cooling is mainly carried out in the simultaneous operation of cooling and heating.

As indicated by the solid-line arrows in the drawing, the high-temperature high-pressure refrigerant gas discharged from the compressor 17 passes through the four-way changeover valve 18, flows into the heat source unit-side heat exchanger 19 where the refrigerant undergoes heat exchange with the heat source water, and is thereby set in a gas-liquid two-phase high-temperature high-pressure state.

Subsequently, the refrigerant in this two-phase high-temperature high-pressure state passes through the third check valve 28 and the second connecting pipe 27, and is supplied to the gas-liquid separator 9 of the relay unit 5.

Here, the refrigerant is separated into the gaseous refrigerant and the liquid refrigerant, and the separated gaseous refrigerant passes consecutively through the second valve 34 and the room unit-side first connecting pipe 26, and flows into the room unit 4 to be heated, where the refrigerant undergoes heat exchange with room air through the room unit-side heat exchanger 21, and condenses and liquefies, thereby heating the interior of the room.

This condensed and liquefied refrigerant is controlled by the subcooled amount at the outlet of the room unit-side heat exchanger 21, passes through the first flow-rate controller 36, where it is slightly decompressed and flows into the second branching section 8.

Meanwhile, a remaining portion of the liquid refrigerant passes through the second flow-rate controller 7 which is controlled the pressure detected by the first pressure-detecting means 41 and the pressure detected by the second pressure-detecting means 42. The refrigerant then converges with the refrigerant which has passed through the room unit 4 to be heated.

The refrigerant consecutively passes through the second branching section 8 and the room unit-side second connecting pipes 29, 30, and flows into the respective room units 2, 3. The refrigerant which has entered the room units 2, 3 is decompressed to a low pressure by the first flow-rate controllers 36 which is controlled by superheated amounts at the outlets of the room unit-side heat exchanger 21. The refrigerant then flows into the room unit-side heat exchanger 21, undergoes heat exchange with room air, and evaporates and gasifies, thereby cooling the interior of the rooms.

The refrigerant in this gaseous state forms a circulation cycle in which the room unit passes through the room unit-side first connecting pipes 24, 25, the first valves 33, the third valves 35, the first connecting pipe 22, the fourth check valve 23, the four-way changeover valve 18 of the heat source unit 1, and the accumulator 20, and is sucked in by the compressor 17, so as to effect the operation in which cooling is mainly performed.

In addition, at that time, the first valves 33 and the third valves 35 connected to the room units 2, 3 are open, while the second valves 34 connected thereto are closed. The second valve 34 connected to the room unit 4 is open, while the first valve 33 and the third valve 35 connected thereto are closed.

Since the first connecting pipe 22 is held under a low pressure and the second connecting pipe 27 under a high pressure at that time, the refrigerant naturally flows to the third check valve 28 and the fourth check valve 23.

During this cycle, part of the liquid refrigerant enters the bypass pipe 37 from the converging portion of the room unit-side second connecting pipes 29, 30, 31 in the second branching section 8, and is decompressed to a low pressure by the third flow-rate controller 15. The decompressed refrigerant is then subjected to heat exchange with the room unit-side second connecting pipes 29, 30, 31 in the second branching section 8 by the third heat exchanger 11, 12, 13, and with the converging portion of the room unit-side second connecting pipes 29, 30, 31 in the second branching section 8 by the second heat-exchange portion 10, and further with the refrigerant flowing into the second flow-rate controller 7 by the first heat-exchange portion 14. The evaporated refrigerant passes through the first connecting pipe 22 and the fourth check valve 23, and further passes through the four-way changeover valve 18 of the heat source unit 1 and the accumulator 20, and is sucked in by the compressor 17.

Meanwhile, the refrigerant at the second branching section 8, which has been cooled after being subjected to heat exchange at the first, second and third heat-exchange portions 14, 10, 11, 12, 13 and provided sufficiently with subcooling, flows into the room units 2, 3 to be cooled.

Next, a description will be given of the control of the fourth valve 43, the fifth valve 44, the sixth valve 45, and the seventh valve 46 when the high-level pressure has risen above a first set pressure.

Figure 5:
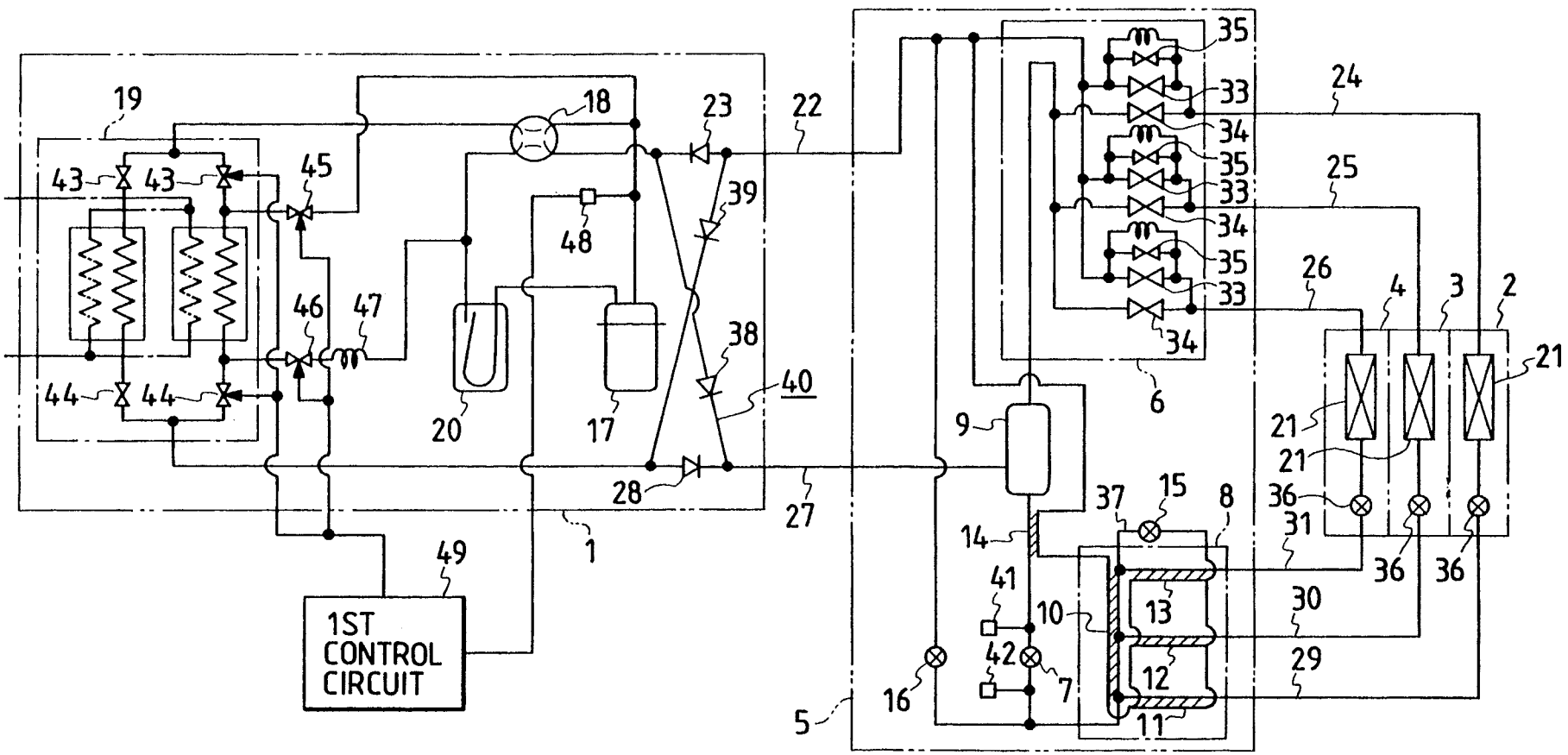
FIG. 5 is a block diagram illustrating a configuration of a control system of a first controller of the air conditioner in accordance with the first embodiment of the present invention.

FIG. 5 shows a mechanism for controlling the fourth valve 43, the fifth valve 44, the sixth valve 45, and the seventh valve 46, and reference numeral 49 denotes a first control circuit for controlling the fourth to seventh valves by means of the pressure detected by the third pressure-detecting means 48.

Figure 6:
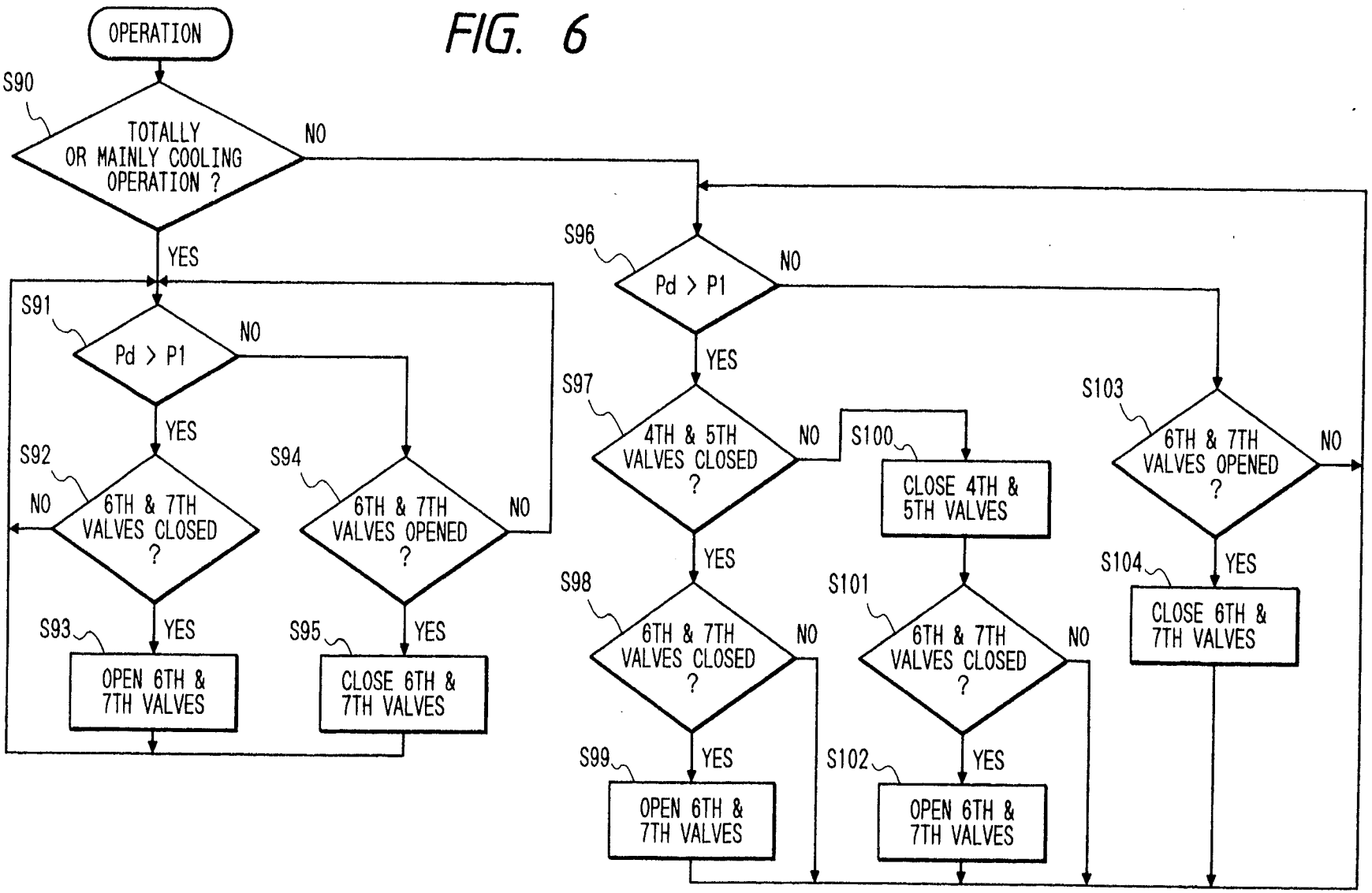
FIG. 6 is a flowchart of the control system of the first controller of the air conditioner in accordance with the first embodiment of the present invention.

FIG. 6 is a flowchart illustrating the details of control effected by the first control circuit 49.

In the air conditioner in accordance with this first embodiment, the high-level pressure becomes high in the case of totally cooling operation and mainly cooling operation when the heat-source water temperature is high. In addition, the high-level pressure becomes high also in the case of totally heating operation and mainly heating operation using a small-capacity room unit when the room air temperature is high. Accordingly, control is effected such that the sixth valve 45 and the seventh valve 46 are opened when the third pressure-detecting means 48 has detected that the high-level pressure is more than the first set pressure. Through the above-described control, the high-pressure liquid refrigerant condensed by the heat exchanger is bypassed to be set to a lower pressure via the capillary tube, so that the high-level pressure and the low-level pressure become low, thereby preventing the air conditioner from stopping due to an abnormality in the high-level pressure.

Next, a description will be given of the details of control effected by the first control circuit 49 in this first embodiment with reference to the flowchart shown in FIG. 6.

When the air conditioner performs totally cooling operation and mainly cooling operation, in Step S91, a comparison is made between a high-level pressure Pd detected by the third pressure-detecting means 48 and a first set pressure P1. Here, if a determination is made that the high-level pressure Pd is greater than the set pressure P1, the operation proceeds to Step S92 to determine whether the sixth valve 45 and the seventh valve 46 are open or closed.

If it is determined in Step S92 that the sixth valve 45 and the seventh valve are closed, the operation proceeds to Step S93 to open the sixth valve 45 and the seventh valve. If it is determined in Step S92 that the sixth valve 45 and the seventh valve 46 are open, the operation returns to Step S91.

If it is determined in Step S91 that the high-level pressure Pd is not more than the first set pressure P1, the operation proceeds to Step S94 to determine whether the sixth valve 45 and the seventh valve are open or closed. If it is determined in Step S94 that the sixth valve 45 and the seventh valve 46 are open, the operation proceeds to Step S95 to close the sixth valve 45 and the seventh valve 46.

If it is determined in Step S94 that the sixth valve 45 and the seventh valve 46 are closed, the operation returns to Step S91.

When the air conditioner performs totally heating operation and mainly cooling operation, in Step S96, a comparison is made between the high-level pressure Pd detected by the third pressure-detecting means 48 and the first set pressure P1. Here, if a determination is made that the high-level pressure Pd is greater than the set pressure P1, the operation proceeds to Step S97 to determine whether the fourth valve 43 and the fifth valve 44 are open or closed.

If it is determined in Step S97 that the fourth valve 43 and the fifth valve 44 are closed, the operation proceeds to Step S98 to determine whether the sixth valve 45 and the seventh valve 46 are open or closed. If it is determined in Step S98 that the sixth valve 45 and the seventh valve 46 are closed, the operation proceeds to Step S99 to open the sixth and seventh valves. If it is determined in Step S99 that the sixth valve 45 and the seventh valve 46 are open, the operation returns to Step S96.

If it is determined in Step S97 that the fourth valve 43 and the fifth valve 44 are open, the fourth valve 43 and the fifth valve 44 are closed in Step S100, and the operation proceeds to Step S101. In Step S101, a determination is made as to whether the sixth valve 45 and the seventh valve 46 are open or closed. If a determination is made that they are open, the operation proceeds to Step S102 to open the sixth valve 45 and the seventh valve 46, and the operation returns to Step S96. If it is determined in Step S101 that the sixth valve 45 and the seventh valve 46 are open, the operation returns to Step S96.

If it is determined in Step S96 that the high-level pressure Pd is not more than the first set pressure P1, the operation proceeds to Step S103 to determine whether the sixth valve 45 and the seventh valve 46 are open or closed. If it is determined in Step S103 that the sixth valve 45 and the seventh valve 46 are open, the operation proceeds to Step S104 to open the sixth valve 45 and the seventh valve 46, and the operation returns to Step S96. If it is determined in Step S104 that the sixth valve 45 and the seventh valve 46 are closed, the operation returns to Step S96.

Second Embodiment

Next, a description will be given of the control of the fourth valve 43, the fifth valve 44, the sixth valve 45, and the seventh valve 46 when the discharge temperature has risen above a first set temperature.

Figure 7:
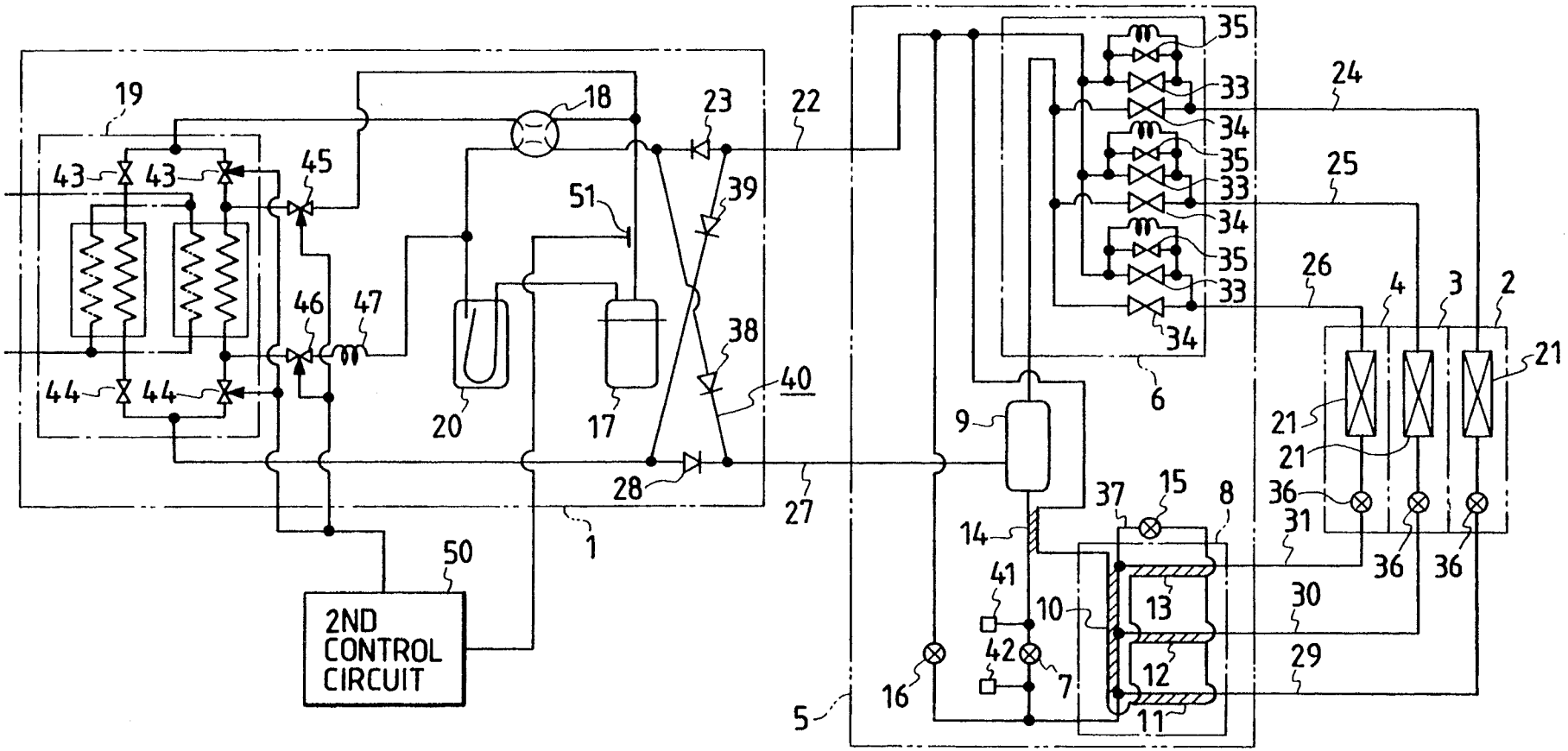
FIG. 7 is a block diagram illustrating a configuration of a control system of a second controller of the air conditioner in accordance with a second embodiment of the present invention.

FIG. 7 shows a mechanism for controlling the fourth valve 43, the fifth valve 44, the sixth valve 45, and the seventh valve 46, and reference numeral 50 denotes a second control circuit for controlling the fourth to seventh valves by means of the pressure detected by a first pressure-detecting means 51.

Figure 8:
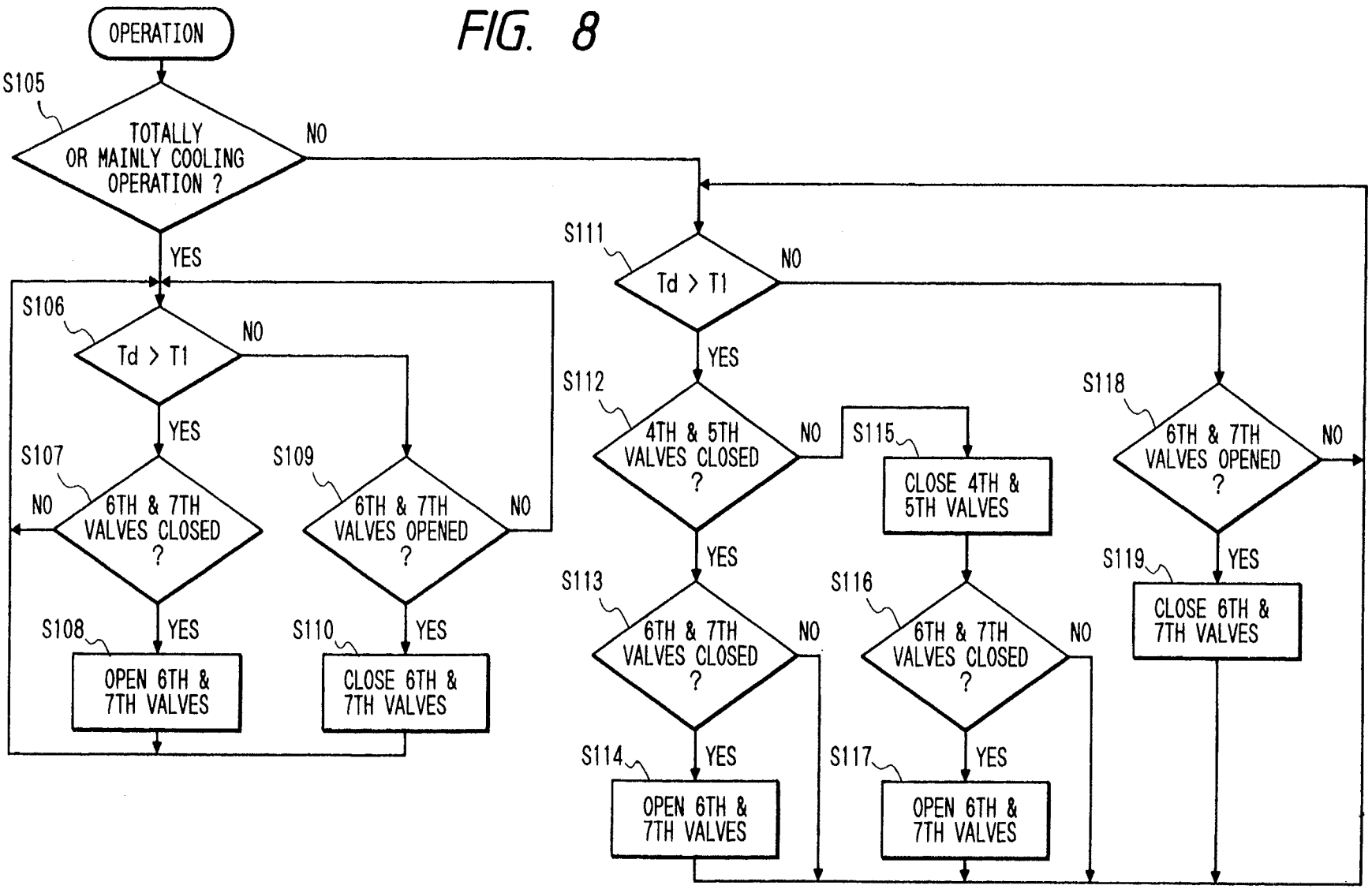
FIG. 8 is a flowchart of the control system of the second controller of the air conditioner in accordance with the second embodiment of the present invention.

FIG. 8 is a flowchart illustrating the details of control effected by the second control circuit 50.

In the air conditioner in accordance with this second embodiment, in the case of totally cooling operation and mainly cooling operation when the heat-source water temperature is high, the discharge temperature becomes high as the high-level pressure becomes high. In addition, in the case of totally heating operation and mainly heating operation using a small-capacity room unit when the room air temperature is high, the discharge temperature also becomes high as the high-level pressure becomes high. Accordingly, control is effected such that the sixth valve 45 and the seventh valve 46 are opened when the first temperature-detecting means 50 has detected that the discharge temperature is more than the first set temperature. Through the above-described control, the high-pressure liquid refrigerant condensed by the heat exchanger is bypassed to be set to a lower pressure via the capillary tube, so that the high-level pressure and the low-level pressure become low, thereby making it possible to control a rise in the discharge temperature.

Next, a description will be given of the details of control effected by the second control circuit 50 in this second embodiment with reference to the flowchart shown in FIG. 8.

When the air conditioner performs totally cooling operation and mainly cooling operation, in Step S106, a comparison is made between a discharge temperature Td detected by the first temperature-detecting means 51 and a first set temperature T1. Here, if a determination is made that the discharge temperature Td is greater than the set temperature T1, the operation proceeds to Step S107 to determine whether the sixth valve 45 and the seventh valve 46 are open or closed.

If it is determined in Step S107 that the sixth valve 45 and the seventh valve 46 are closed, the operation proceeds to Step S108 to open the sixth valve 45 and the seventh valve 46. If it is determined in Step S107 that the sixth valve 45 and the seventh valve 46 are open, the operation returns to Step S106.

If it is determined in Step S106 that the discharge temperature Td is not more than the first set temperature T1, the operation proceeds to Step S109 to determine whether the sixth valve and the seventh valve 46 are open or closed. If it is determined in Step S109 that the sixth valve 45 and the seventh valve 46 are open, the operation proceeds to Step S110 to close the sixth valve 45 and the seventh valve 46.

If it is determined in Step S109 that the sixth valve and the seventh valve 46 are closed, the operation returns to Step S106.

When the air conditioner performs totally heating operation and mainly cooling operation, in Step S111, a comparison is made between the discharge temperature Td detected by the first temperature-detecting means 51 and the first set temperature T1. Here, if a determination is made that the discharge temperature Td is greater than the set temperature T1, the operation proceeds to Step S112 to determine whether the fourth valve 43 and the fifth valve 44 are open or closed.

If it is determined in Step S112 that the fourth valve 43 and the fifth valve 44 are closed, the operation proceeds to Step S113 to determine whether the sixth valve 45 and the seventh valve 46 are closed. If it is determined in Step S113 that the sixth valve 45 and the seventh valve 46 are closed, the operation proceeds to Step S114 to open the sixth valve 45 and the seventh valve 46. If it is determined in Step S113 that the sixth valve 45 and the seventh valve 46 are open, the operation returns to Step S111.

If it is determined in Step S112 that the fourth valve 43 and the fifth valve 44 are open, the fourth valve 43 and the fifth valve 44 are closed in Step S115, and the operation proceeds to Step S116. In Step S116, a determination is made as to whether the sixth valve 45 and the seventh valve 46 are open or closed. If a determination is made that they are closed, the operation proceeds to Step S117 to open the sixth valve 45 and the seventh valve 46, and the operation returns to Step S111. If it is determined in Step S116 that the sixth valve 45 and the seventh valve 46 are closed, the operation returns to Step S111.

If it is determined in Step S111 that the discharge temperature Td is not more than the first set temperature T1, the operation proceeds to Step S118 to determine whether the sixth valve 45 and the seventh valve are open or closed. If it is determined in Step S118 that the sixth valve 45 and the seventh valve 46 are open, the operation proceeds to Step S119 to close the sixth valve 45 and the seventh valve 46, and the operation returns to Step S111. If it is determined in Step S118 that the sixth valve 45 and the seventh valve 46 are closed, the operation returns to Step S111.

Third Embodiment

Next, a description will be given of the control of the fourth valve 43, the fifth valve 44, the sixth valve 45, and the seventh valve 46 when the low-level pressure has risen above a second set pressure.

Figure 9:
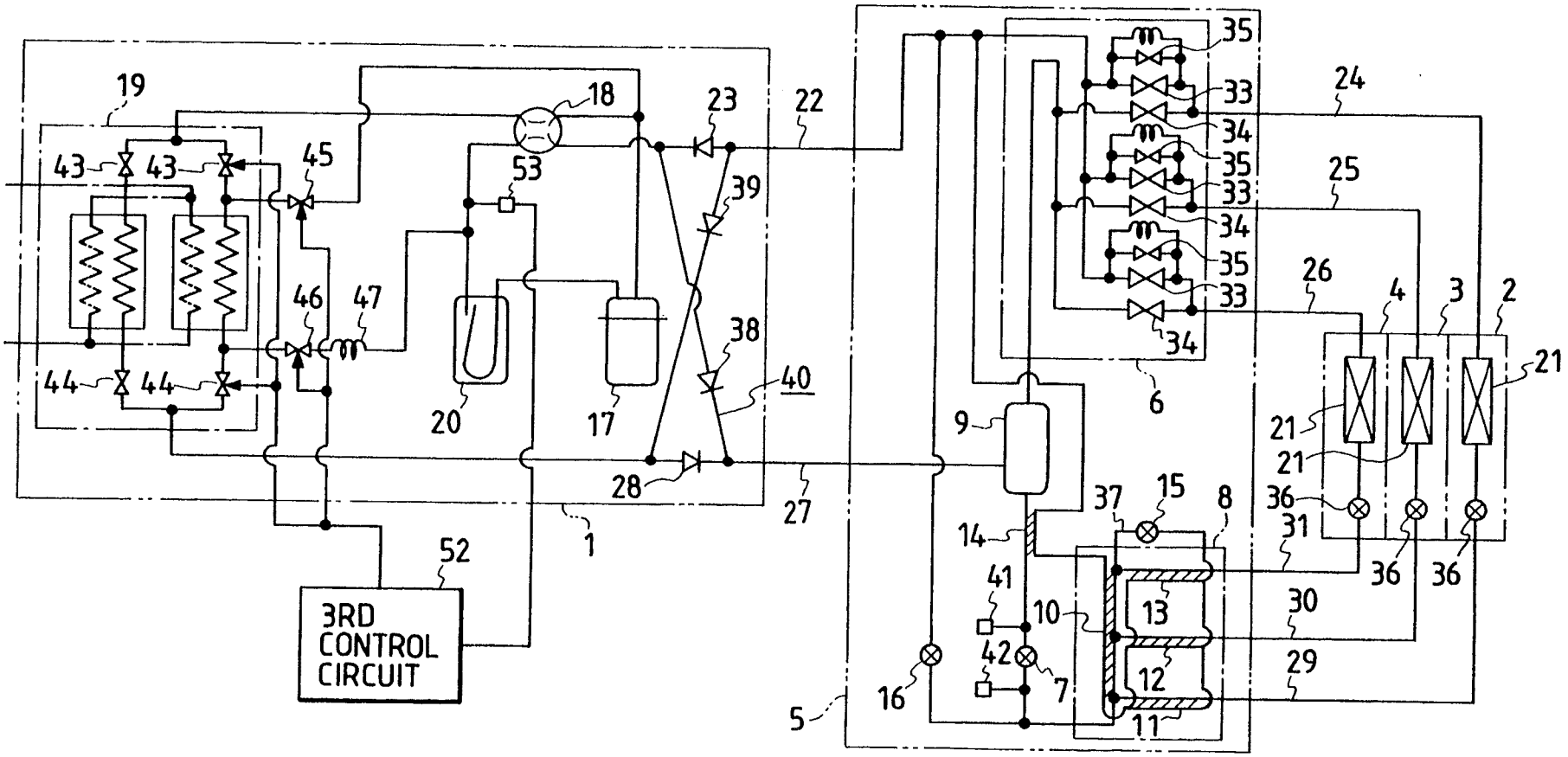
FIG. 9 is a block diagram illustrating a configuration of a control system of a third controller of the air conditioner in accordance with a third embodiment of the present invention.

FIG. 9 shows a mechanism for controlling the fourth valve 43, the fifth valve 44, the sixth valve 45, and the seventh valve 46, and reference numeral 52 denotes a third control circuit for controlling the fourth to seventh valves by means of the pressure detected by a fourth pressure-detecting means 53.

Figure 10:
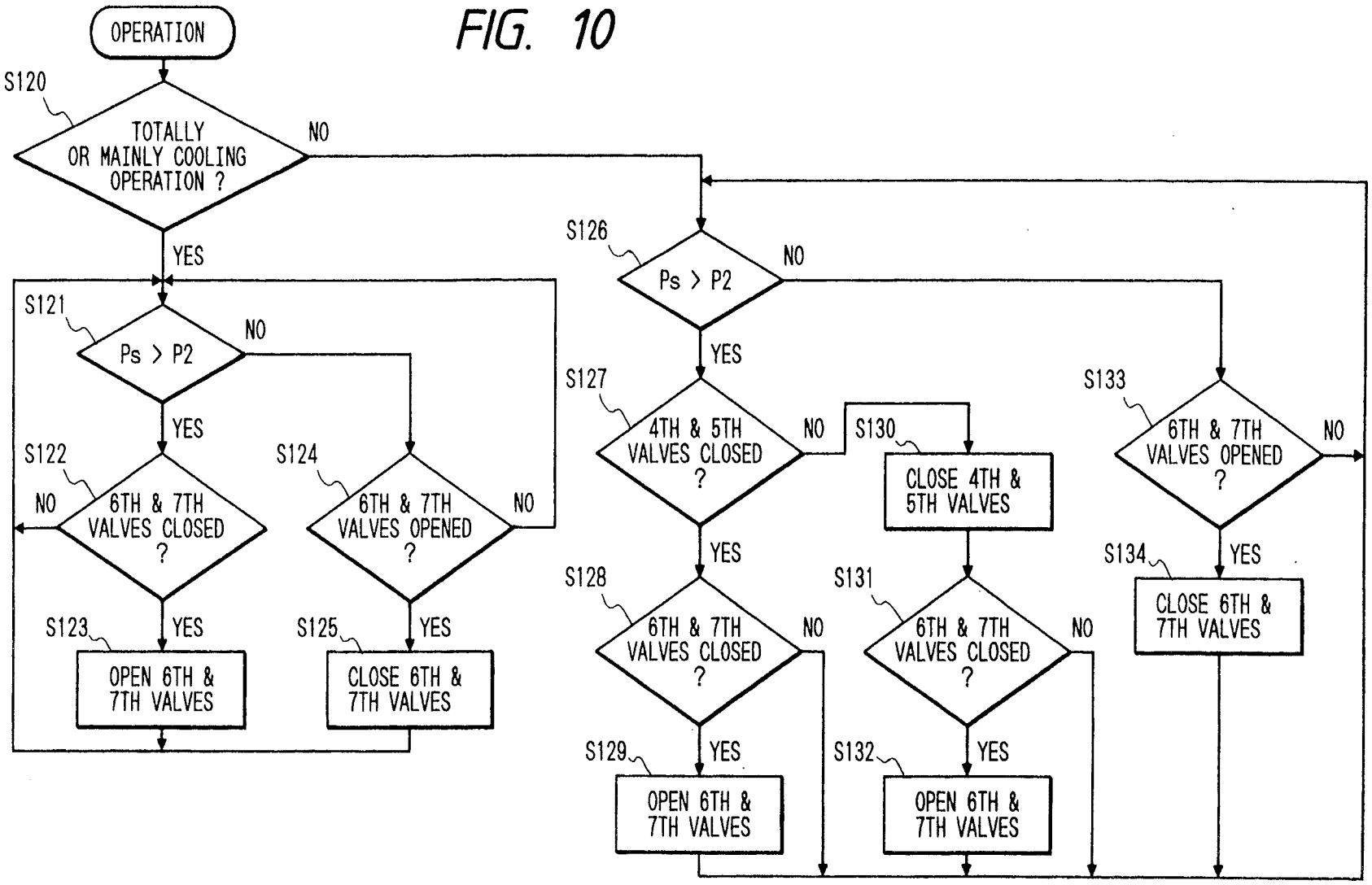
FIG. 10 is a flowchart of the control system of the third controller of the air conditioner in accordance with the third embodiment of the present invention.

FIG. 10 is a flowchart illustrating the details of control effected by the third control circuit 52.

In the air conditioner in accordance with this third embodiment, in the case of totally heating operation and mainly heating operation when the heat-source water temperature is high, the low-level pressure becomes high since the evaporation temperature is high. Accordingly, control is effected such that the sixth valve 45 and the seventh valve 46 are closed when the fourth pressure-detecting means 53 has detected that the low-level pressure is more than the second set pressure. Through the above-described control, the high-pressure liquid refrigerant condensed by the heat exchanger is bypassed to be set to a lower pressure via the capillary tube, thereby preventing adverse effect from being exerted on the reliability of the compressor.

Next, a description will be given of the details of control effected by the third control circuit 52 in this third embodiment with reference to the flowchart shown in FIG. 10.

When the air conditioner performs totally cooling operation and mainly cooling operation, in Step S121, a comparison is made between a low-level pressure Ps detected by the fourth pressure-detecting means 53 and a second set pressure P2. Here, if a determination is made that the low-level pressure Ps is greater than the set pressure P2, the operation proceeds to Step S122 to determine whether the sixth valve 45 and the seventh valve 46 are open or closed.

If it is determined in Step S122 that the sixth valve 45 and the seventh valve 46 are closed, the operation proceeds to Step S123 to open the sixth valve 45 and the seventh valve 46. If it is determined in Step S122 that the sixth valve 45 and the seventh valve 46 are open, the operation returns to Step S121.

If it is determined in Step S121 that the low-level pressure Ps is not more than the second set pressure P2, the operation proceeds to Step S124 to determine whether the sixth valve 45 and the seventh valve 46 are open or closed. If it is determined in Step S124 that the sixth valve 45 and the seventh valve 46 are open, the operation proceeds to Step S125 to close the sixth valve 45 and the seventh valve 46.

If it is determined in Step S124 that the sixth valve 45 and the seventh valve 46 are closed, the operation returns to Step S121.

When the air conditioner performs totally heating operation and mainly cooling operation, in Step S126, a comparison is made between the low-level pressure Ps detected by the fourth pressure-detecting means 53 and the second set pressure P2. Here, if a determination is made that the low-level pressure Ps is greater than the set pressure P2, the operation proceeds to Step S127 to determine whether the fourth valve 43 and the fifth valve 44 are open or closed.

If it is determined in Step S127 that the fourth valve 43 and the fifth valve 44 are closed, the operation proceeds to Step S128 to determine whether the sixth valve 45 and the seventh valve 46 are open or closed. If it is determined in Step S128 that the sixth valve 45 and the seventh valve 46 are closed, the operation proceeds to Step S129 to open the sixth connecting pipe 45 and the seventh valve 46. If it is determined in Step S128 that the sixth valve 45 and the seventh valve 46 are open, the operation returns to Step S126.

If it is determined in Step S127 that the fourth valve 43 and the fifth valve 44 are open, the fourth valve 43 and the fifth valve 44 are closed in Step S130, and the operation proceeds to Step S131. In Step S131, a determination is made as to whether the sixth valve 45 and the seventh valve 46 are open or closed. If a determination is made that they are closed, the operation proceeds to Step S132 to open the sixth valve 45 and the seventh valve 46, and the operation returns to Step S126. If it is determined in Step S131 that the sixth valve 45 and the seventh valve 46 are open, the operation returns to Step S126.

If it is determined in Step S126 that the low-level pressure Ps is not more than the second set pressure P2, the operation proceeds to Step S133 to determine whether the sixth valve 45 and the seventh valve 46 are open or closed. If it is determined in Step S133 that the sixth valve 45 and the seventh valve 46 are open, the operation proceeds to Step S134 to close the sixth valve 45 and the seventh valve 46, and the operation returns to Step S126. If it is determined in Step S133 that the sixth valve 45 and the seventh valve are closed, the operation returns to Step S126.

Fourth Embodiment

Next, a description will be given of the control of the fourth valve 43, the fifth valve 44, the sixth valve 45, and the seventh valve 46 when the evaporation temperature has risen above a second set temperature.

Figure 11:
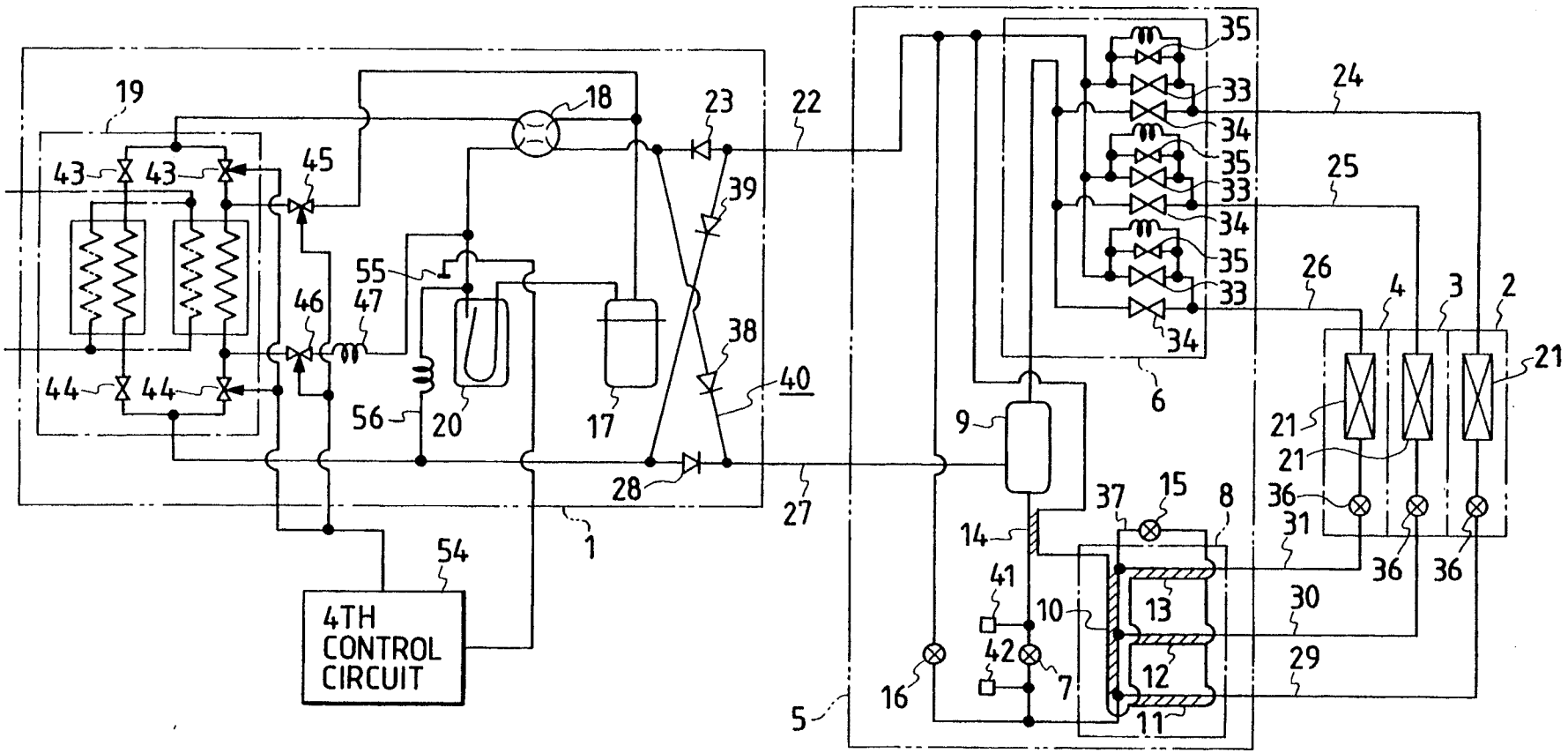
FIG. 11 is a block diagram illustrating a configuration of a control system of a fourth controller of the air conditioner in accordance with a fourth embodiment of the present invention.

FIG. 11 shows a mechanism for controlling the fourth valve 43, the fifth valve 44, the sixth valve 45, and the seventh valve 46, and reference numeral 54 denotes a fourth control circuit for controlling the fourth to seventh valves by means of the temperature detected by a second temperature-detecting means 55. The second temperature-detecting means 55 detects the evaporation temperature at a evaporation-temperature detecting circuit 56 in which the accumulator 20 and the heat source unit-side heat exchanger 19 are connected by means of a capillary tube.

Figure 12:
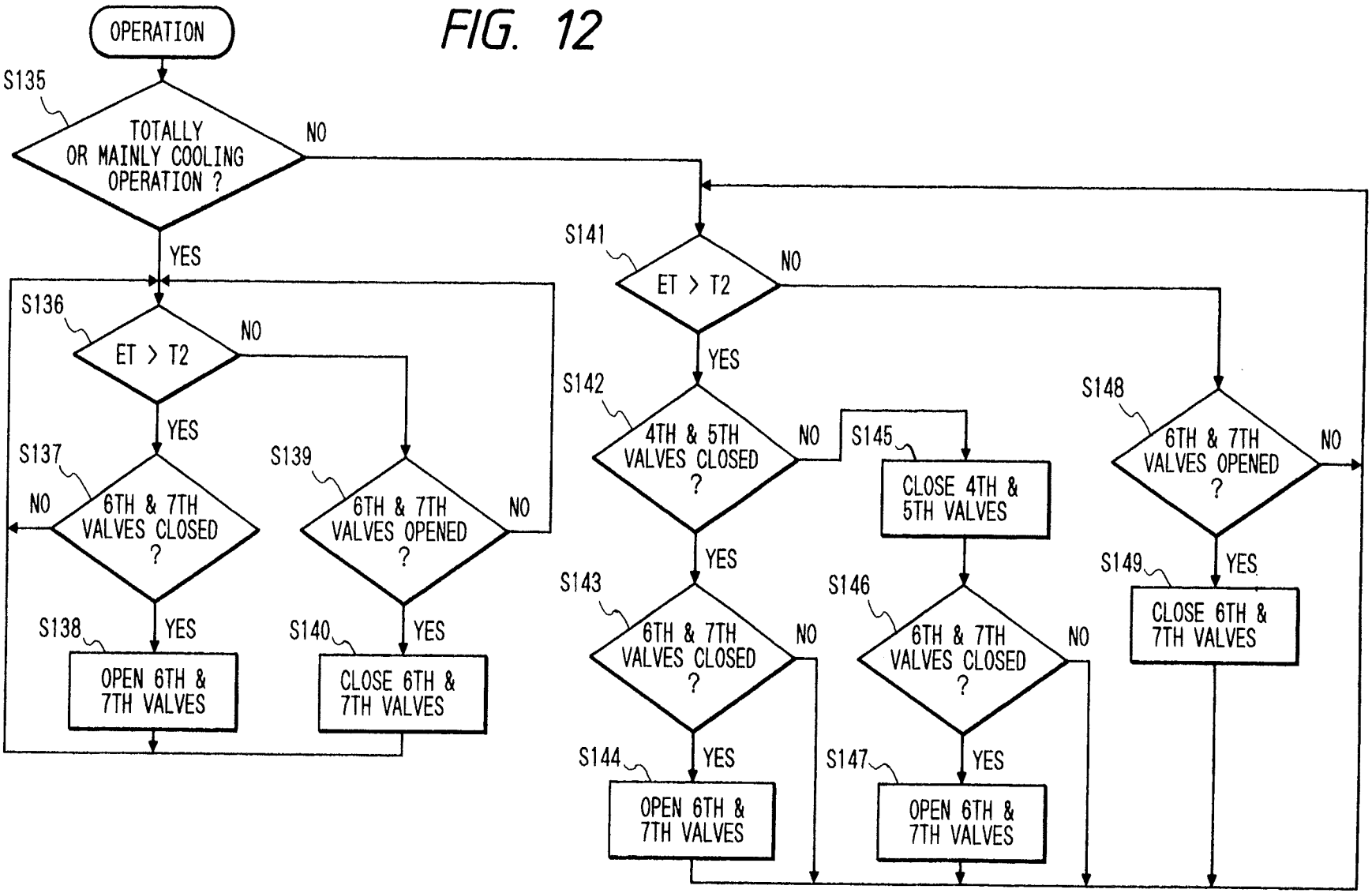
FIG. 12 is a flowchart of the control system of the fourth controller of the air conditioner in accordance with the fourth embodiment of the present invention.
Figure 13:
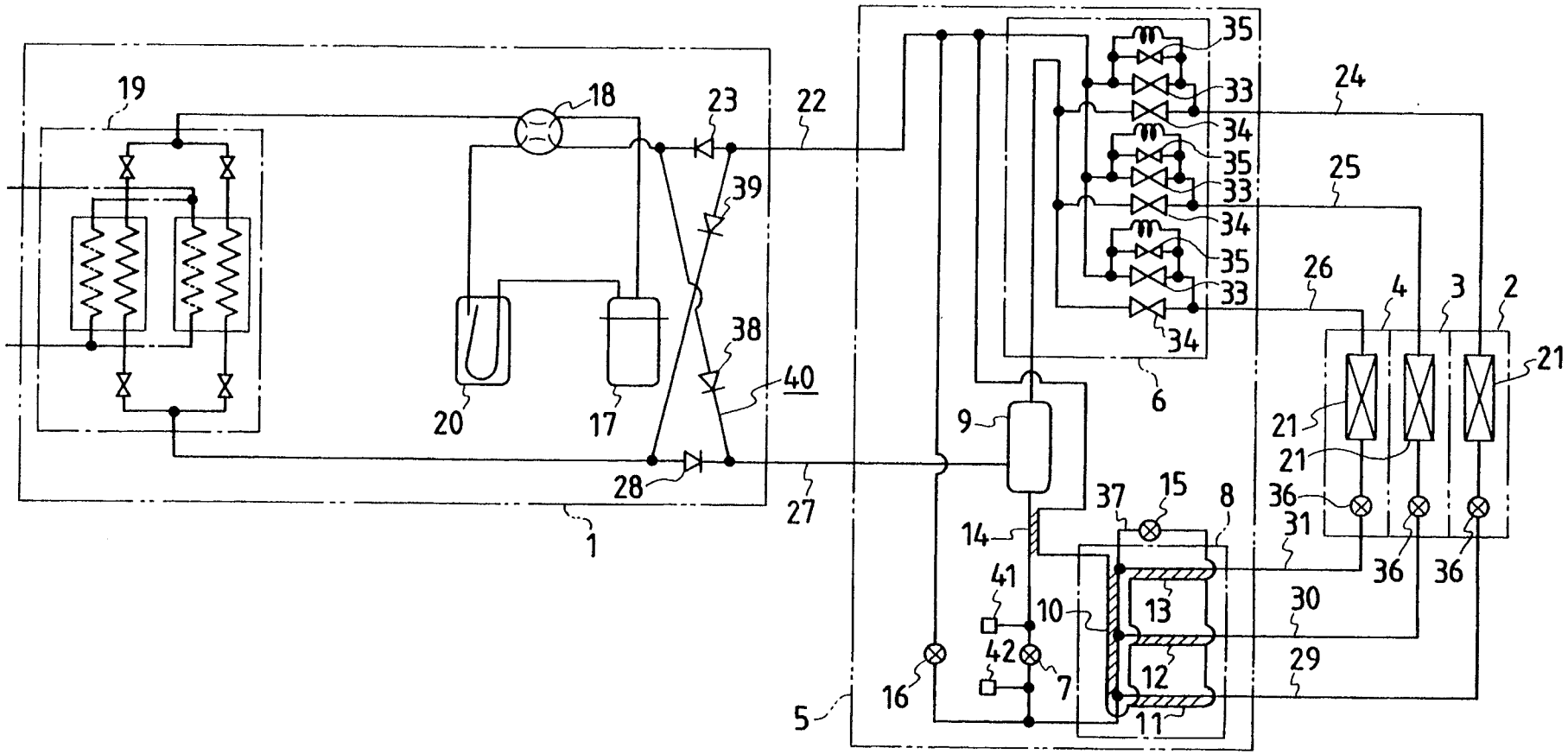
FIG. 13 (PRIOR ART)
FIG. 13 is an overall schematic diagram of an air conditioner in accordance with a prior art example relating to the invention, centering on the refrigerant system.
Figure 14:
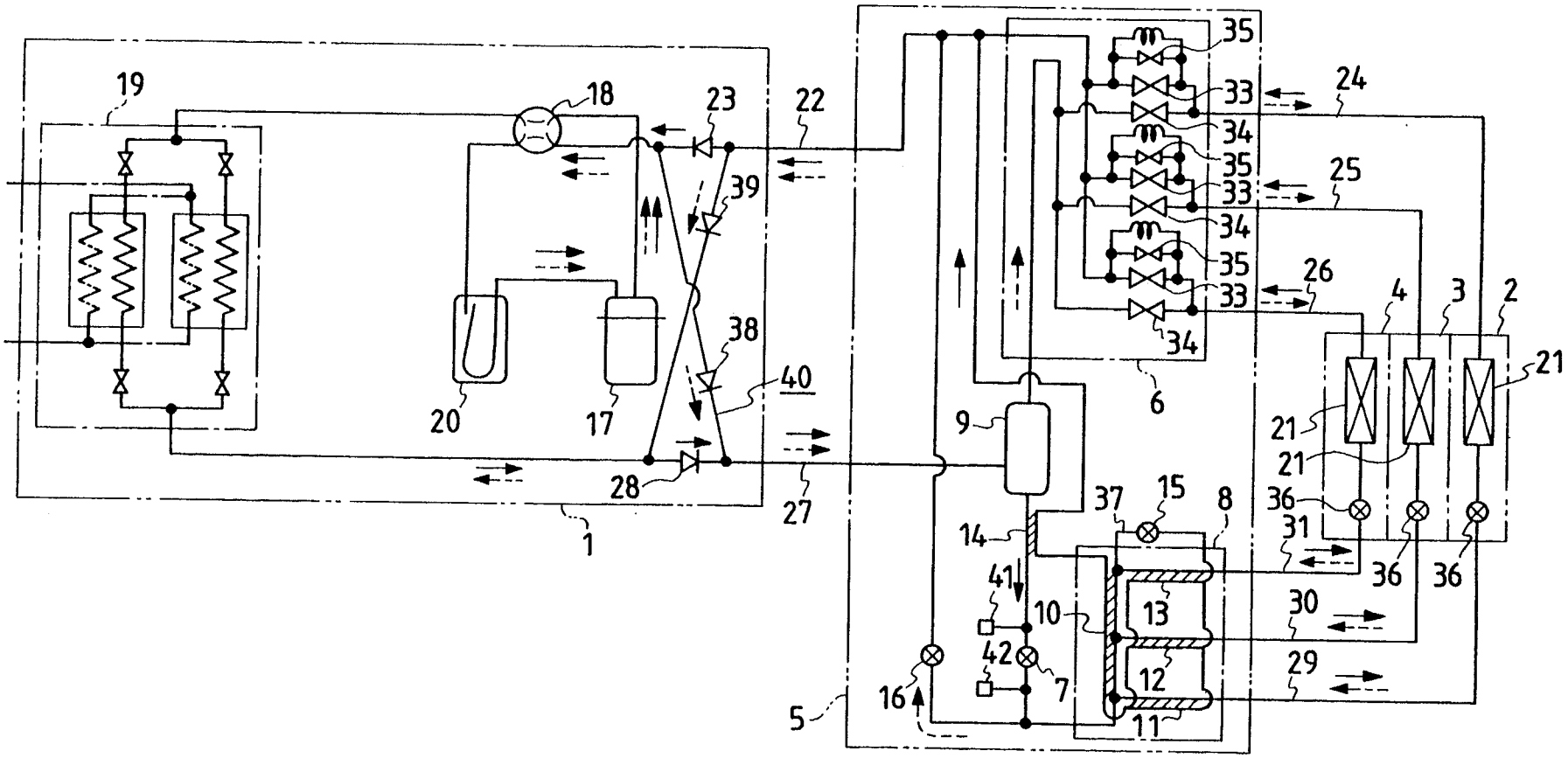
FIG. 14 (PRIOR ART)
FIG. 14 is a circuit diagram of the refrigerant illustrating the state of operation of only cooling or heating by the air conditioner in accordance with the prior art example relating to the present invention.
Figure 15:
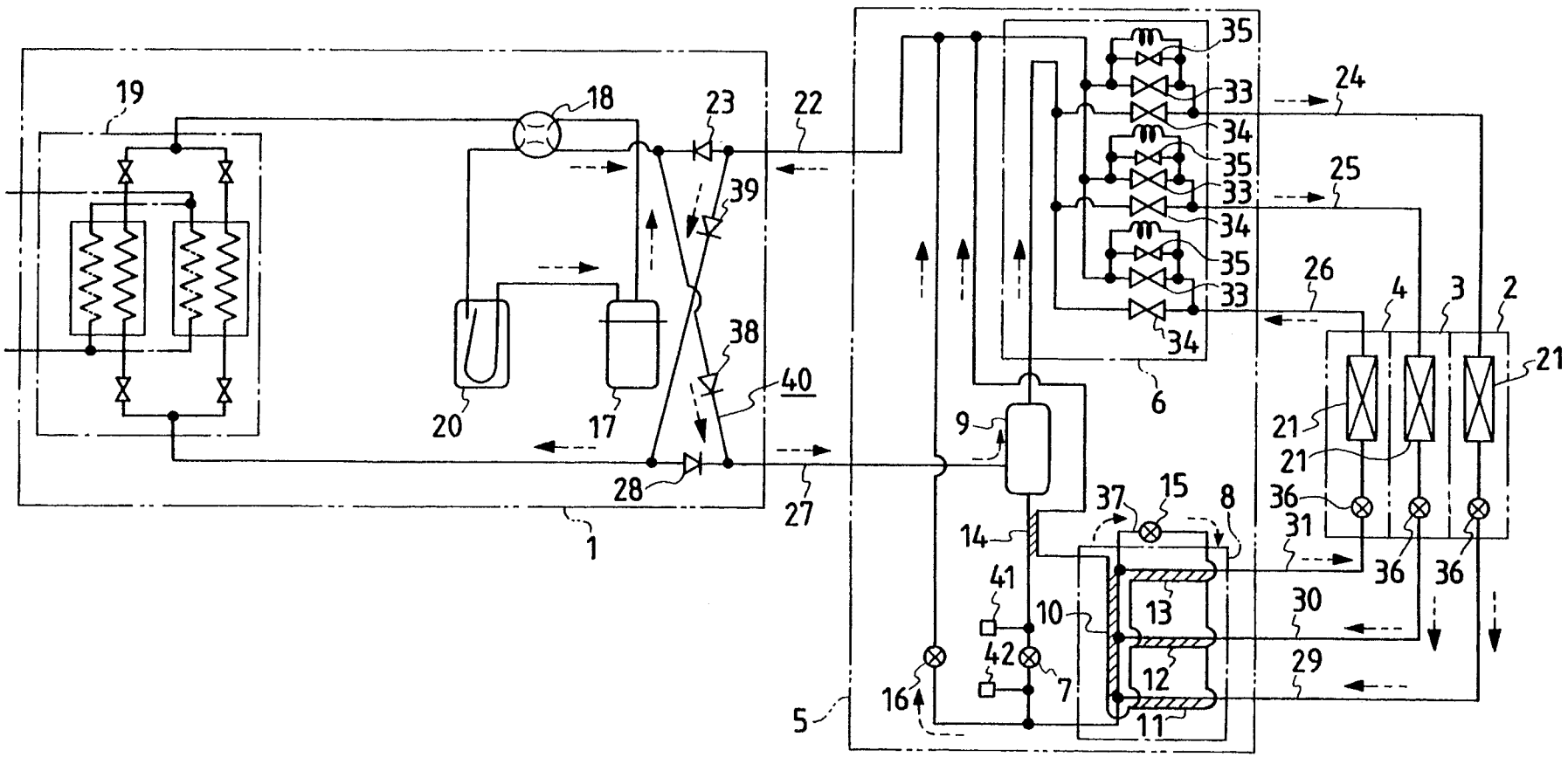
FIG. 15 (PRIOR ART)
FIG. 15 is a circuit diagram of the refrigerant illustrating the state of operation of mainly heating by the air conditioner in accordance with the prior art example relating to the present invention.
Figure 16:
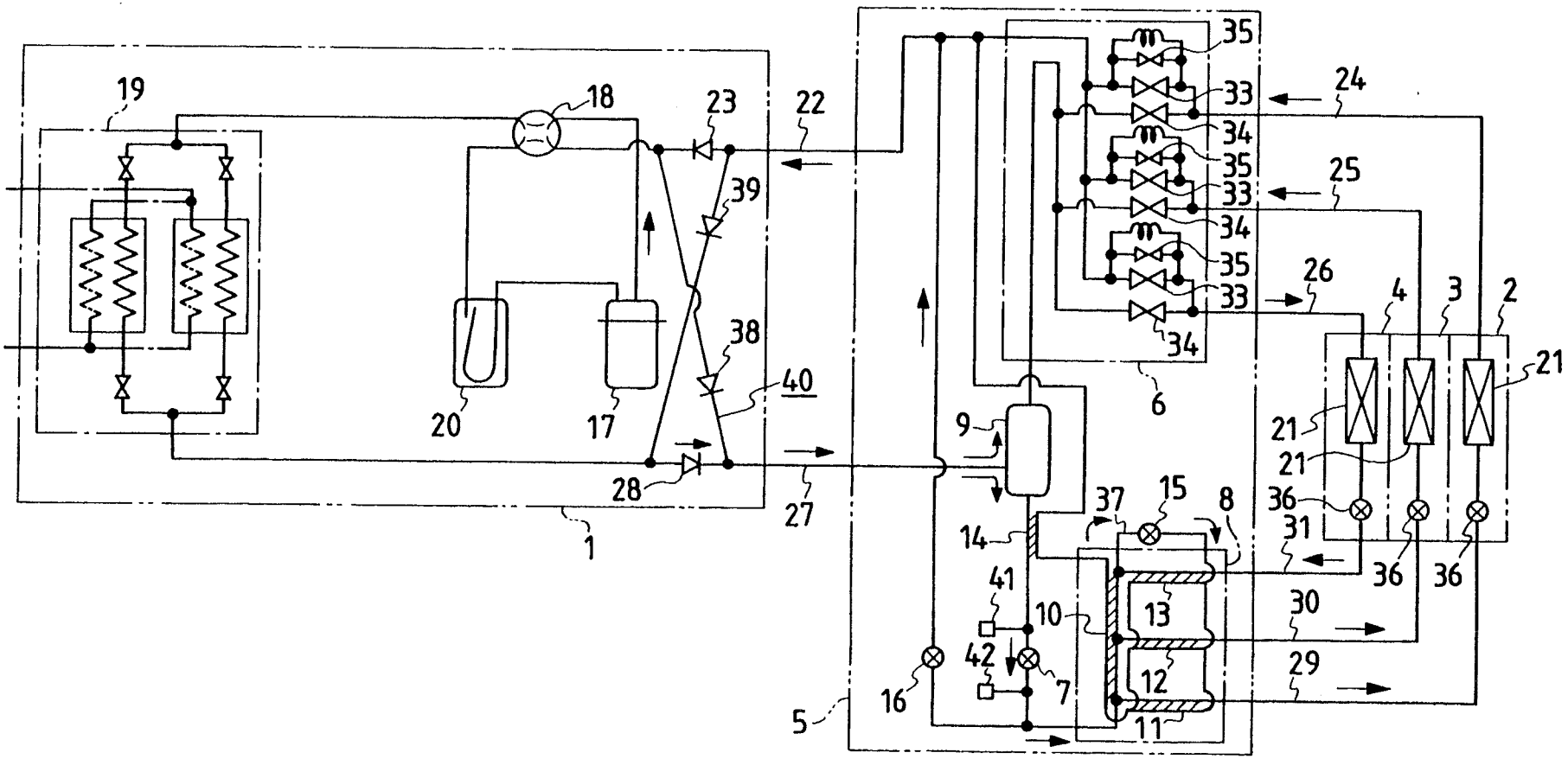
FIG. 16 (PRIOR ART)
FIG. 16 is a circuit diagram of the refrigerant illustrating the state of operation of mainly cooling by the air conditioner in accordance with the prior art example relating to the present invention.

FIG. 12 is a flowchart illustrating the details of control effected by the fourth control circuit 54.

In the air conditioner in accordance with this fourth embodiment as well, the evaporation temperature becomes high in the case of totally heating operation and mainly heating operation when the heat-source water temperature is high. Accordingly, control is effected such that the sixth valve 45 and the seventh valve 46 are opened when the second temperature-detecting means 55 has detected that the evaporation temperature is more than the second set temperature. Through the above-described control, the high-pressure liquid refrigerant condensed by the heat exchanger is bypassed to be set to a lower pressure via the capillary tube, so that the evaporation temperature becomes low, thereby making it possible to secure a cooling capability in the mainly heating operation.

Finally, a description will be given of the details of control effected by the fourth control circuit 54 in this fourth embodiment with reference to the flowchart shown in FIG. 12.

When the air conditioner performs totally cooling operation and mainly cooling operation, in Step S136, a comparison is made between a evaporation temperature ET detected by the second temperature-detecting means 55 and a second set temperature T2. Here, if a determination is made that the evaporation temperature ET is greater than the set pressure T2, the operation proceeds to Step S137 to determine whether the sixth valve 45 and the seventh valve 46 are open or closed.

If it is determined in Step S137 that the sixth valve 45 and the seventh valve are closed, the operation proceeds to Step S138 to open the sixth valve 45 and the seventh valve 46. If it is determined in Step S137 that the sixth valve 45 and the seventh valve 46 are open, the operation returns to Step S136.

If it is determined in Step S136 that the evaporation temperature ET is not more than the second set temperature T2, the operation proceeds to Step S139 to determine whether the sixth valve 45 and the seventh valve 46 are open or closed. If it is determined in Step S139 that the sixth valve 45 and the seventh valve 46 are open, the operation proceeds to Step S135 to close the sixth valve 45 and the seventh valve 46.

If it is determined in Step S139 that the sixth valve 45 and the seventh valve 46 are closed, the operation returns to Step S136.

When the air conditioner performs totally heating operation and mainly cooling operation, in Step S141, a comparison is made between the evaporation temperature ET detected by the second temperature-detecting means 55 and the second set temperature T2. Here, if a determination is made that the evaporation temperature ET is greater than the set pressure T2, the operation proceeds to Step S142 to determine whether the fourth valve 43 and the fifth valve 44 are open or closed.

If it is determined in Step S142 that the fourth valve 43 and the fifth valve 44 are closed, the operation proceeds to Step S143 to determine whether the sixth valve 45 and the seventh valve 46 are open or closed. If it is determined in Step S143 that the sixth valve 45 and the seventh valve 46 are closed, the operation proceeds to Step S144 to open the sixth 45 and the seventh valve 46. If it is determined in Step S143 that the sixth valve 45 and the seventh valve 46 are open, the operation returns to Step S146.

If it is determined in Step S142 that the fourth valve 43 and the fifth valve 44 are open, the fourth valve 43 and the fifth valve 44 are closed in Step S145, and the operation proceeds to Step S146. In Step S146, a determination is made as to whether the sixth valve 45 and the seventh valve 46 are open or closed. If a determination is made that they are closed, the operation proceeds to Step S147 to open the sixth valve 45 and the seventh valve 46, and the operation returns to Step S141. If it is determined in Step S146 that the sixth valve 45 and the seventh valve 46 are open, the operation returns to Step S141.

If it is determined in Step S141 that the evaporation temperature ET is not more than the second set temperature T2, the operation proceeds to Step S148 to determine whether the sixth valve 45 and the seventh valve 46 are open or closed. If it is determined in Step S148 that the sixth valve 45 and the seventh valve 46 are open, the operation proceeds to Step S149 to close the sixth valve 45 and the seventh valve 46, and the operation returns to Step S141. If it is determined in Step S148 that the sixth valve 45 and the seventh valve 46 are closed, the operation returns to Step S141.

As described above, in accordance with the present invention, it is possible to effect control in such a manner as to suppress an excessive rise in the high-level pressure by means of the pressure-detecting means for detecting the pressure within the discharge-side pipe of the compressor and by means of the control circuit for controlling the valves; it is possible to effect control in such a manner as to suppress an excessive rise in the discharge temperature by means of the temperature-detecting means for detecting the discharge-side temperature of the compressor and by means of the control circuit for controlling the valves; it is possible to effect control in such a manner as to suppress an excessive rise in the low-level pressure by means of the pressure-detecting means for detecting the pressure within the inlet-side pipe of the accumulator and by means of the control circuit for controlling the valves; and it is possible to effect control in such a manner as to suppress an excessive rise of the evaporation temperature by means of the temperature-detecting means for detecting the evaporation temperature of the evaporation-temperature detecting circuit which connects the liquid side of the heat source unit-side heat exchanger and the inlet of the accumulator and by means of the control circuit. Accordingly, an advantage is offered in that, in an air conditioner in which cooling and heating are effected selectively by a plurality of room units and cooling is effected by one room unit and heating by another, it is possible to perform operation while ensuring a suitable evaporation temperature in mainly heating operation, without stopping due to an abnormality in the high-level pressure and an abnormality in the discharge temperature and without impairing the reliability of the compressor.

What is claimed is:

1. An air conditioner comprising:

a heat source unit including:

a compressor, a four-way changeover valve, a plurality of heat exchangers connected in parallel with each other and each having a fourth valve and a fifth valve at inlet and outlet ports thereof, and an accumulator;

a plurality of room units, each of said room units including:

a room unit-side heat exchanger, and a first flow-rate controller;

said heat source unit and said room units being connected to each other via a first connecting pipe and a second connecting pipe; and a relay unit including:

a gas-liquid separator disposed in a room unit-side pipe end of said second connecting pipe;

a first branching section having a first valve and second valve for allowing one end of said room unit-side heat exchanger to communicate selectively with said first connecting pipe or a gas-side output port of said gas-liquid separator;

a second branching section in which another end of said room unit-side heat exchanger is connected to said first flow-rate controller through said second connecting pipe;

a second flow-rate controller interposed between said first and second branching sections;

a bypass pipe having one end connected to said second branching section and another end connected to said first connecting pipe through a third flow-rate controller;

a fourth flow-rate controller interposed between said second branching section and said first connecting pipe; and a heat-exchange portion for effecting heat exchange between said bypass pipe and a pipe which connects together said second connecting pipe and said first flow-rate controller;

wherein a gas-side of one of said heat exchangers of said heat source unit-side heat exchangers and a discharge side of said compressor are connected to each other via a sixth valve, a liquid side of said one heat source unit-side heat exchanger and an inlet port of said accumulator are connected to each other via a capillary tube and a seventh valve, and said air conditioner further comprises:

detecting means for detecting a condition of refrigerant which is circulated within the above mentioned circular system; and control circuit means for controlling said sixth valve and said seventh valve in response to the detection result of said detecting means.

2. An air conditioner as claimed in claim 1, wherein said detection means includes pressure-detecting means for detecting the pressure within a discharge-side pipe of said compressor and a control circuit for controlling such that when the pipe pressure is below a predetermined pressure, said sixth valve and said seventh valve, are closed, and when the pipe pressure exceeds the predetermined pressure, said sixth valve and said seventh valve are opened.

3. An air conditioner as claimed in claim 1, wherein said detection means includes temperature-detecting means for detecting the temperature of a discharge side of said compressor and a control circuit for controlling such that when the discharge temperature is below a predetermined temperature, said sixth valve and said seventh valve are closed, and when the discharge temperature exceeds the predetermined temperature, said sixth valve and said seventh valve are opened.

4. An air conditioner as claimed in claim 1, wherein said detection means includes pressure-detecting means for detecting a pressure within an inlet port-side pipe of said accumulator and a control circuit for controlling such that when the pipe pressure is below a predetermined pressure, said sixth valve and said seventh valve are closed, and when the pipe pressure exceeds the predetermined pressure, said sixth valve and said seventh valve are opened.

5. An air conditioner as claimed in claim 1, wherein said detection means includes temperature-detecting means for detecting an evaporation temperature in said capillary tube and a control circuit for controlling such that when the evaporation temperature is below a predetermined temperature, said sixth valve and said seventh valve are closed, and when the evaporation temperature exceeds the predetermined temperature, said sixth valve and said seventh valve are opened.

* * * * *